US005550003A

United States Patent [19]

Inoue

[11] Patent Number: 5,550,003

[45] Date of Patent: Aug. 27, 1996

[54] SILVER HALIDE PHOTOGRAPHIC PHOTOSENSITIVE MATERIALS AND A METHOD OF IMAGE FORMATION IN WHICH THEY ARE USED

[75] Inventor: Nobuaki Inoue, Kanagawa, Japan

[73] Assignee: Fuji Photo Film Co., Ltd., Kanagawa, Japan

[21] Appl. No.: 301,633

[22] Filed: Sep. 7, 1994

Related U.S. Application Data

[63] Continuation-in-part of Ser. No. 170,800, Dec. 21, 1993, abandoned.

[30] Foreign Application Priority Data

Dec. 24, 1992 [JP] Japan ..... 4-357381
Feb. 4, 1993 [JP] Japan ..... 5-017431

[51] Int. Cl.[6] ..... G03C 5/315

[52] U.S. Cl. ..... 430/264; 430/523; 430/537; 430/570; 430/598; 430/605

[58] Field of Search ..... 430/264, 598, 430/605, 523, 533, 527, 583, 602, 435, 537, 570

[56] References Cited

U.S. PATENT DOCUMENTS

| | | | |
|---|---|---|---|
| 4,837,140 | 6/1989 | Ikeda et al. | 430/583 |
| 4,994,365 | 2/1991 | Looker et al. | 430/598 |
| 5,041,355 | 8/1991 | Machonkin et al. | 430/264 |
| 5,075,198 | 12/1991 | Katoh | 430/583 |
| 5,122,445 | 6/1992 | Ishigaki | 430/523 |
| 5,204,214 | 4/1993 | Okamura et al. | 430/264 |
| 5,208,139 | 5/1993 | Ishigaki | 430/523 |
| 5,236,807 | 8/1993 | Inoue et al. | 430/264 |
| 5,252,426 | 10/1993 | Chan | 430/264 |
| 5,279,933 | 1/1994 | Gingello et al. | 430/264 |
| 5,288,590 | 2/1994 | Kuwabara et al. | 430/264 |

FOREIGN PATENT DOCUMENTS

| | | |
|---|---|---|
| 0490302 | 6/1992 | European Pat. Off. . |
| 20490302 | 6/1992 | European Pat. Off. . |
| 4214551 | 8/1992 | Japan . |

OTHER PUBLICATIONS

Keller, Science and Technology of Photography, Chapter 2, pp. 18–20 and 239–242, Weinheim, 1993.

*Primary Examiner*—Hoa Van Le
*Attorney, Agent, or Firm*—Sughrue, Mion, Zinn, Macpeak & Seas

[57] ABSTRACT

A silver halide photographic photosensitive material comprises an emulsion layer which includes silver halide grains having a silver chloride content of at least 50 mol % and containing a rhodium compound. The material also comprises, (i) a hydrazine derivative according to formula (1), (2) or (3) which formulas are shown and defined in the specification, and (ii) at least one compound selected from colloidal silica and polyacrylamide derivatives. The material further comprises a protective layer, the outermost layer of which has a dynamic friction coefficient is not more than 0.35. The material may be processed in a developer having a pH of at least 9.6 but less than 11.0.

18 Claims, No Drawings

SILVER HALIDE PHOTOGRAPHIC PHOTOSENSITIVE MATERIALS AND A METHOD OF IMAGE FORMATION IN WHICH THEY ARE USED

This is a Continuation-in-Part of application Ser. No. 08/170,800 filed Dec. 21, 1993, now abandoned.

FIELD OF THE INVENTION

This invention concerns silver halide photographic photosensitive materials. In particular, it concerns ultra-high contrast silver halide photographic photosensitive materials which are used for photographic plate making purposes.

BACKGROUND OF THE INVENTION

Image forming systems which exhibit photographic characteristics of ultra-high contrast (especially those of gamma (γ) at least 10) are required to improve the reproduction of continuous gradation images by means of a screen dot image or to improve the reproduction of line images in the graphic arts field.

There is a demand for image forming systems with which ultra-high contrast photographic characteristics are obtained with development with a developer which has good storage stability. There is also a demand for methods in which surface latent image type silver halide photographic photosensitive materials to which specified acylhydrazine compounds have been added are processed in a developer of pH 11.0 to 12.3 which contains at least 0.15 mol/liter of sulfite preservative and negative images of ultra-high contrast with gamma exceeding 10 are formed. Systems of this type have been suggested in U.S. Pat. Nos. 4,166,742, 4,168,977, 4,221,857, 4,224,401, 4,243,739, 4,272,606 and 4,311,781. These new image forming systems are distinguished by allowing the use of silver iodobromides and silver chloroiodobromides, rather than only allowing the use of silver chlorobromides which have a high silver chloride content as in the case of conventional ultrahigh contrast image formation systems. Furthermore, it is possible to use a large amount of sulfite preservative, instead of only the very small amount of sulfite preservative which is possible in conventional lith developers, and so there is the further distinguishing feature that storage stability is comparatively good.

However developers of pH 11 or above are susceptible to aerial oxidation and are unstable, and they cannot endure long term storage or use.

Means of forming high contrast images by developing silver halide photosensitive materials which contain hydrazine compounds in a developer of lower pH have been investigated.

Methods of processing with development in a developer of pH 11.0 or below using sensitive materials which contain nucleation development accelerators which have groups which are adsorbed onto silver halide grains, or nucleating agents which have similar adsorbing groups, have been disclosed in JP-A-1-179939 and JP-A-1-179940. (The term "JP-A" as used herein signifies an "unexamined published Japanese patent application".) However, the emulsions used in these inventions are of silver bromide or silver iodobromide, and there is considerable variation in photographic performance resulting from changes in the composition of the developer and development progression, and they cannot be said to be satisfactory in terms of stability.

Hydrazine compounds which have ethylene oxide repeating units and hydrazine compounds which have pyridinium groups have been disclosed in U.S. Pat. Nos. 4,998,604, 4,994,365 and 4,975,354. However, according to the illustrative examples given, the high contrast is inadequate in these inventions and it is difficult to obtain the $D_{max}$ and a required high contrast under practical development conditions.

Furthermore, nucleation high-contrast materials in which hydrazine derivatives are used exhibit a very wide variation in photographic properties depending on fluctuations in the pH of the developer. The pH of the developer fluctuates widely, being increased by the aerial oxidation of the developer and concentration due to the evaporation of water, and being reduced by the absorption of carbon dioxide from the air. Hence, means of minimizing developer pH dependence of photographic performance have also been investigated.

Examples of the use of chemically sensitized silver chlorobromides in systems in which hydrazines are used have been disclosed, for example, in JP-A-53-20921, JP-A-60-83028, JP-A-60-140399, JP-A-63-46437, JP-A-63-103230, JP-A-3-294844, JP-A-3-294845, JP-A-4-174424 and Japanese Patent Application No. 3-188230. On the other hand, examples in which hydrazines are used conjointly with silver halide emulsions which contain heavy metal complexes, such as rhodium or iridium complexes, have been disclosed, for example, JP-A-60-83028, JP-A-61-47942, JP-A-61-47943, JP-A-61-29837, JP-A-62-201233, JP-A-62-235947 and JP-A-63-103232.

Cases in which colloidal silica and polyacrylamide derivatives are included in systems in which the hydrazine is used have been disclosed in many patents such as JP-A-61-140939, JP-A-1-156734 and JP-A-4-214551.

Many cases of the inclusion of cyanine dyes which have an anionic charge, starting with the alkali salts of 5,5'-dichloro-9-ethyl-3,3'-bis(3-sulfopropyl)-oxacarbocyanine, in systems in which hydrazine is being used have been disclosed, such as those disclosed, for example, in JP-A-61-29837, JP-A-62-235947, JP-A-62-280733, JP-A-62-280734, JP-A-2-40, JP-A-2-124560, JP-A-2-262653 and JP-A-3-63641.

SUMMARY OF THE INVENTION

One object of this invention is to provide silver halide photographic photosensitive materials with which very high contrast photographic properties with gamma exceeding 10 can be obtained using a stable developer, and which are strong with respect to pressure sensitization.

A second object of the invention is to provide silver halide photographic photosensitive materials which provide a high contrast using developers of pH 11 or below, with which variation in performance is small even when processing large amounts of film, and with which there is little occurrence of black spotting even after processing in developers in which aerial oxidation has progressed.

These and other objects have been realized by means of a silver halide photographic photosensitive material comprising a support, having thereon at least one silver halide emulsion layer and at least one protective layer over the emulsion layer. The silver halide emulsion is comprised of silver halide grains having a silver chloride content of at least 50 mol % which contain from $1\times10^{-8}$ to $5\times10^{-6}$ mol of a rhodium compound per mol of silver. At least one hydrazine derivative selected from among those of general formula (1), (2) or (3) indicated below is included in at least one of the emulsion layer or another hydrophilic colloid layer. At least one compound selected from among colloidal silica and polyacrylamide derivatives is included in at least one of the silver halide layer and another hydrophilic colloid layer. The dynamic friction coefficient of the outermost layer of the protective layer is not more than 0.35.

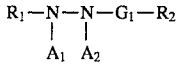

General Formula (1)

In this formula, $R_1$ represents an aliphatic group or an aromatic group which includes a partial structure $—O—(CH_2CH_2O)_n—$, $—O—(CH_2CH(CH_3)O)_n—$ or $—O—(CH_2CH(OH)CH_2O)_n—$ (where n is an integer of 3 or more) as part of a substituent group, or which contains a quaternary ammonium cation as part of a substituent group. $G_1$ represents —CO—, —COCO—, —CS—, $—C(=NG_2R_2)—$, —SO—, $—SO_2—$ or $—P(O)(G_2R_2)—$. $G_2$ represents a single bond, —O—, —S— or $—N(R_2)—$, $R_2$ represents an aliphatic group, an aromatic group or a hydrogen atom, and in those cases where a plurality of $R_2$ groups is present within the hydrazine derivative of formula (1), these groups may be the same or different.

One of $A_1$ and $A_2$ is a hydrogen atom, and the other represents a hydrogen atom or an acyl group, or an alkyl or aryl sulfonyl group.

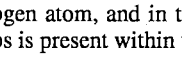

General Formula (2)

In this formula, $R_1$ represents an aliphatic group, an aromatic group or a heterocyclic group, and it may be substituted. G represents —CO—, $—SO_2—$, —SO—, —COCO—, a thiocarbonyl, an iminomethylene group or $—P(O)(R_3)—$, and $R_2$ represents a substituted alkyl group in which the carbon atom which is substituted by G is substituted with at least one electron attractive group. $R_3$ represents a hydrogen atom, an aliphatic group, an aromatic group, an alkoxy group, an aryloxy group or an amino group. $R_1$ and $R_2$ of formula (2) do not contain a silver halide adsorptive group.

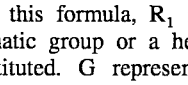

General Formula (3)

In this formula, $A_1$ and $A_2$ are both hydrogen atoms or one is a hydrogen atom and the other represents a sulfinic acid residual group or an acyl group, $R_a$ represents an aliphatic group, an aromatic group or a heterocyclic group, $R_b$ represents a hydrogen atom, an alkyl group, an aryl group, an alkoxy group, an aryloxy group or an amino group, and $G_1$ represents a carbonyl group, a sulfonyl group, a sulfoxy group, a phosphoryl group or an iminomethylene group. At least one of $R_a$ and $R_b$ is a group which promotes adsorption on silver halide.

DETAILED DESCRIPTION OF THE INVENTION

The hydrazine derivatives which are used in the invention are described in detail below.

In general formula (1), $R_1$ represents an aliphatic group or an aromatic group which includes a partial structure $—O—(CH_2CH_2O)_n—$, $—O—(CH_2CH(CH_3)O)_n—$ or $—O—(CH_2CH(OH)CH_2O)_n—$ (where n is an integer of value 3 or more) as part of a substituent group, or which contains a quaternary ammonium cation as part of a substituent group. $G_1$ represents —CO—, —COCO—, —CS—, $—C(=NG_2R_2)—$, —SO—, $—SO_2—$ or $—P(O)(G_2R_2)—$. $G_2$ represents a single bond, —O—, —S— or $—N(R_2)—$, $R_2$ represents an aliphatic group, an aromatic group or a hydrogen atom, and in those cases where a plurality of $R_2$ groups is present within the hydrazine derivative of formula (1), these groups may be the same or different.

One of $A_1$ and $A_2$ is a hydrogen atom, and the other represents a hydrogen atom or an acyl group, or an alkyl or arylsulfonyl group.

General formula (1) is described in detail below.

In general formula (1), the aliphatic groups represented by $R_1$ have a carbon number 1 to 30, and especially linear chain, branched or cyclic alkyl groups of a carbon number 1 to 20. The alkyl groups have substituent groups.

An aromatic group represented by $R_1$ in general formula (1) is a single ring or double ring aryl group or unsaturated heterocyclic group. An unsaturated heterocyclic group may be condensed with an aryl group and form a hetero-aryl group.

For example, it is a benzene ring, a naphthalene ring, a pyridine ring, a quinoline ring or an isoquinoline ring. Those groups which contain a benzene ring are preferred.

An aryl group is most desirable for $R_1$.

The aliphatic or aromatic groups of $R_1$ may be substituted groups, and typical substituent groups include, for example, alkyl groups, aralkyl groups, alkenyl groups, alkynyl groups, alkoxy groups, aryl groups, substituted amino groups, ureido groups, urethane groups, aryloxy groups, sulfamoyl groups, carbamoyl groups, alkylthio groups, arylthio groups, sulfonyl groups, sulfinyl groups, a hydroxy group, halogen atoms, a cyano group, a sulfo group, aryloxycarbonyl groups, acyl groups, alkoxycarbonyl groups, acyloxy groups, carboxamido groups, sulfonamido group, carboxyl group, phosphoric acid amido groups and the like. Examples of preferred substituent groups include linear chain, branched or cyclic alkyl groups (preferably those of a carbon number 1 to 20), aralkyl groups (preferably those of a carbon number 7 to 30), alkoxy groups (preferably those of a carbon number 1 to 30), substituted amino groups (preferably amino groups substituted with alkyl groups of a carbon number 1 to 30), acylamino groups (preferably those of a carbon number 2 to 40), sulfonamido groups (preferably those of a carbon number of 1 to 40), ureido groups (preferably those of a carbon number 1 to 40), and phosphoric acid amido groups (preferably those of a carbon number 1 to 40).

The aliphatic groups, aromatic groups or the substituent groups thereof of $R_1$ include $—O—(CH_2CH_2O)_n—$, $—O—(CH_2CH(CH_3)O)_n—$ or $—O—(CH_2CH(OH)CH_2O)_n—$, or they include a quaternary ammonium cation. Moreover, n is an integer of value 3 or more, and it is preferably an integer of at least 3, but not more than 15.

$R_1$ is preferably represented by general formula (H1), general formula (H2), general formula (H3) or general formula (H4) indicated below.

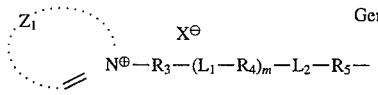

General Formula (H1)

-continued

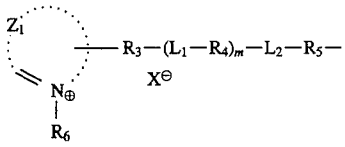

General Formula (H2)

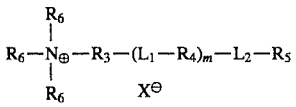

General Formula (H3)

$R_6-O-(L_3)_n-R_3-(L_1-R_4)_m-L_2\ R_5$ General Formula (H4)

In these formulae, $L_1$ and $L_2$ represent —$CONR_7$—, —$NR_7CONR_8$—, —$SO_2NR_7$— or —$NR_7SO_3NR_8$, and they may be the same or different groups. $R_7$ and $R_8$ represent hydrogen atoms or alkyl groups of a carbon number 1 to 6 or an aryl group of a carbon number 6 to 10, and they are preferably hydrogen atoms. Moreover, m is 0 or 1.

$R_3$, $R_4$ and $R_5$ are divalent aliphatic groups or aromatic groups, and they are preferably alkylene groups or arylene groups or divalent groups which are obtained by combining these groups with —O—, —CO—, —S—, —SO—, —$SO_2$— and —$NR_9$— (where $R_9$ has the same significance as $R_2$ in general formulae (1), (2) and (3)).

More desirably, $R_3$ is an alkylene group of a carbon number 1 to 10 or a divalent group obtained by combining these groups with —S—, —SO— and —$SO_2$—, and $R_4$ and $R_5$ are arylene groups of a carbon number 6 to 20. $R_5$ is most desirably a phenylene group.

$R_3$, $R_4$ and $R_5$ may be substituted, and the preferred substituent groups are those cited as substituent groups for $R_1$.

In general formulae (H1) and (H2), $Z_1$ represents a group of atoms which is required to form a nitrogen containing aromatic ring. Preferred examples of nitrogen containing aromatic rings which are formed by the nitrogen atom and $Z_1$ include a pyridine ring, a pyrimidine ring, a pyridazine ring, a pyrazine ring, an imidazole ring, a pyrazole ring, a pyrrole ring, an oxazole ring, a thiazole ring and structures in which these rings are condensed with a benzene ring, and also a pteridine ring and a naphthilidine ring.

$X^-$ in general formulae (H2), (H3) and (H4) is a counter-anion or, in those cases where an intramolecular salt is formed, a counter-anion part.

$R_6$ in general formulae (H2), (H3) and (H4) represents an aliphatic group or an aromatic group. $R_6$ is preferably an alkyl group of a carbon number 1 to 20 or an aryl group of a Carbon number 6 to 20.

The three $R_6$ groups in general formula (H3) may be the same or different, and they may be joined together to form rings.

$Z_1$ and $R_6$ may be substituted, and the substituent groups cited as substituent groups for $R_1$ are preferred as substituent groups.

$L_3$ in general formula (H4) represents —$CH_2CH_2O$—, —$CH_2CH(CH_3)O$— or —$CH_2CH(OH)$—$CH_2O$—, and n has the same significance as in general formula (H1).

A —CO— group or an —$SO_2$— group is preferred for $G_1$ in general formula (1), and a —CO— group is most desirable.

Hydrogen atoms are preferred for $A_1$ and $A_2$.

Alkyl groups of carbon number 1 to 4 are preferred for the aliphatic group represented by $R_2$ in general formula (1), and single ring or double ring aryl groups (for example those which contain a benzene ring) are preferred as the aromatic groups.

In cases where $G^1$ is a —CO— group, of the groups which can be represented by $R_2$, the hydrogen atom, the alkyl groups (for example, methyl, methoxymethyl, phenoxymethyl, trifluoromethyl, 3-hydroxypropyl, 3-methanesulfonamidopropyl, phenylsulfonylmethyl), the aralkyl groups (for example, o-hydroxybenzyl), and the aryl groups (for example, phenyl, 3,5-dichlorophenyl, o-methanesulfonamidophenyl, 4-methanesulfonylphenyl, 2-hydroxymethylphenyl), for example, are preferred, and the hydrogen atom is especially desirable.

$R_2$ may be substituted, and the substituent groups cited in connection with $R_1$ can be used as substituent groups.

Furthermore, $R_2$ may be a group such that the $G_1$—$R_2$ part separates from the rest of the molecule and a cyclization reaction in which a ring structure which contains the atoms of —$G_1$—$R_2$ part is formed occurs. Such a case has been disclosed, for example, in JP-A-63-29751.

$R_1$ or $R_2$ in general formula (1) may contain a ballast group or polymer as normally used in immobile photographically useful additives such as couplers for example. A ballast group in a comparatively inert group in terms of photographic properties which has a carbon number of at least 8, and such groups can be selected, for example, from among the alkyl groups, alkoxy groups, phenyl groups, alkylphenyl groups, phenoxy groups and alkylphenoxy groups. Furthermore, the polymers disclosed, for example, in JP-A-1-100530 can be cited as examples of polymers.

A group which is strongly adsorbed on the surface of a silver halide grain may be incorporated into $R_1$ or $R_2$ in general formula (1). Adsorption groups of this type include the thiourea groups, heterocyclic thioamido groups, mercapto-heterocyclic groups and triazole groups, for example, disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The compounds of general formula (1) of this invention can be prepared, for example, using the methods disclosed, for example, in JP-A-61-213847, JP-A-62-260153, U.S. Pat. No. 4,684,604, Japanese Patent Application No. 63-803, U.S. Pat. Nos. 3,379,529, 3,620,746, 4,377,634 and 4,332,878, JP-A-49-129536, JP-A-56-153336, JP-A-56-153342 and U.S. Pat. Nos. 4,988,604 and 4,994,365.

Compounds which can be used in this invention are indicated below, but the invention is not limited to those indicated below.

Compound 1-1
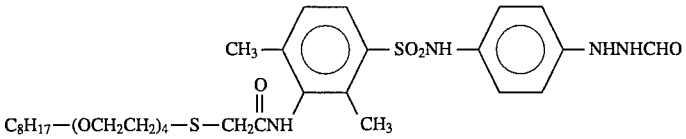
Compound 1-2
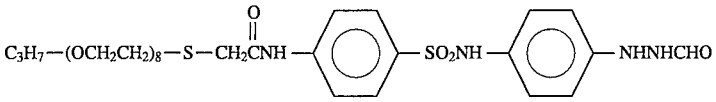
Compound 1-3
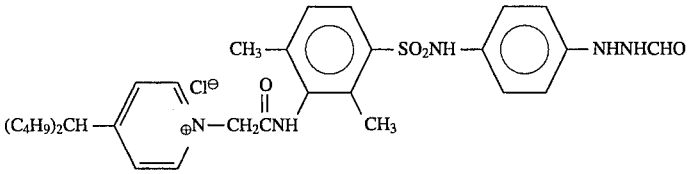
Compound 1-4
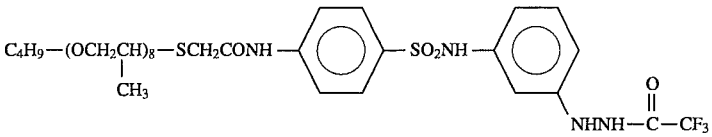
Compound 1-5
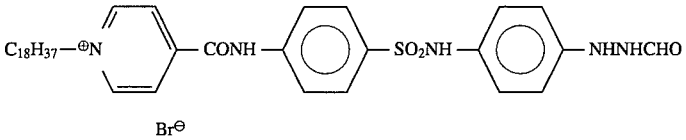
Compound 1-6
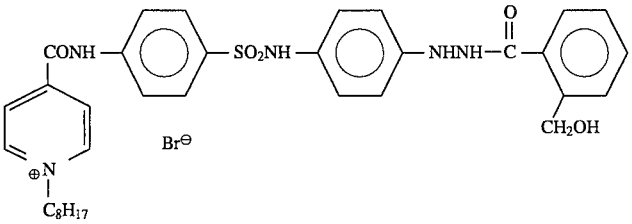
Compound 1-7
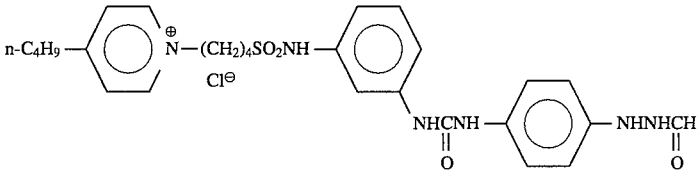
Compound 1-8
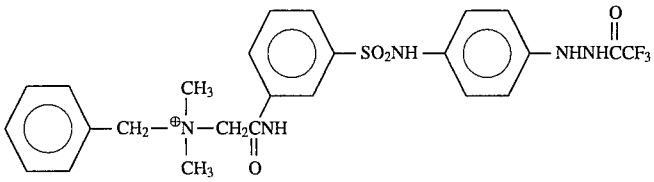
Compound 1-9
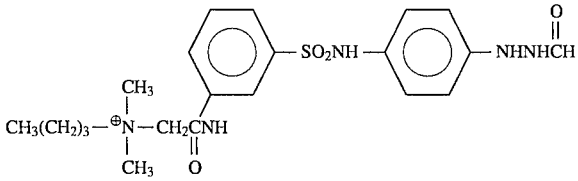

-continued

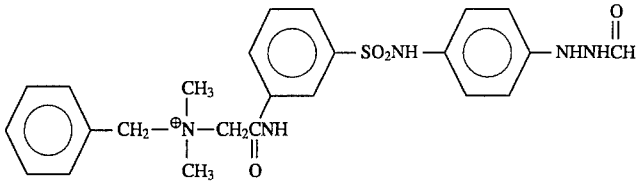

Compound 1-10

The compounds which can be represented by general formula (2) are described in detail below.

In general formula (2), the aliphatic groups represented by $R_1$ preferably have 1 to 20 carbon atoms and may be linear chain, branched or cyclic alkyl groups, alkenyl groups or alkynyl groups.

The aromatic groups represented by $R_1$ are single ring or double ring aryl groups, for example a phenyl group or a naphthyl group.

The heterocyclic groups represented by $R_1$ are from three- to ten-membered saturated or unsaturated heterocyclic groups which contain at least one species from among N, O and S atoms, and they may be single rings or they may form condensed rings with other aromatic or heterocyclic rings. The five- or six-membered aromatic heterocyclic rings are preferred as heterocyclic rings. For example, those which contain a pyridyl group, an imidazolyl group, a quinolinyl group, a benzimidazolyl group, a pyrimidyl group, a pyrazolyl group, an isoquinolinyl group, a thiazolinyl group or a benzthiazolyl group are preferred.

Aromatic groups, nitrogen containing heterocyclic groups and groups which can be represented by general formula (b) are preferred for $R_1$.

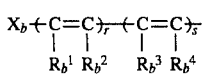

General Formula (b)

(In this formula, $X_b$ represents an aromatic group or a nitrogen containing heterocyclic group, and $R_b^1$ to $R_b^4$ each represents a hydrogen atom, a halogen atom or an alkyl group, and $X_b$ and $R_b^1$ to $R_b^4$ may have substituent groups in those cases where this is possible. Moreover, r and s represent 0 or 1.)

$R_1$ is preferably an aromatic group, and an aryl group is especially desirable.

$R_1$ may be substituted with substituent groups. For example, alkyl groups, aralkyl groups, alkenyl groups, alkynyl groups, alkoxy groups, aryl groups, substituted amino groups, aryloxy groups, sulfamoyl groups, carbamoyl groups, alkylthio groups, arylthio groups, sulfonyl groups, sulfinyl groups, hydroxy group, halogen atoms, cyano group, sulfo group and carboxyl group, alkyl and aryl oxycarbonyl groups, acyl groups, alkoxycarbonyl groups, acyloxy groups, carboxamido groups, sulfonamido groups, nitro group, alkylthio groups, arylthio groups, and groups which can be represented by the general formula (c) indicated below can be cited as substituent groups.

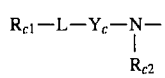

General Formula (c)

In formula (c), $Y_c$ represents —CO—, —$SO_2$—, —P(O)($R_{c3}$)— (where $R_{c3}$ represents an alkoxy group or an aryloxy group) or —OP(O)($R_{c3}$)—, and L represents a single bond, —O—, —S— or —$NR_{c4}$— (where $R_{c4}$ represents a hydrogen atom, an aliphatic group or an aromatic group).

$R_{c1}$ and $R_{c2}$ represent hydrogen atoms, aliphatic groups, aromatic groups or heterocyclic groups, and they may be the same or different, and they may be joined together to form a ring.

Furthermore, $R_1$ may contain one or a plurality of groups represented by general formula (c).

In general formula (c), the aliphatic groups represented by $R_{cl}$ preferably have 1 to 20 carbon atoms and more preferably 1 to 10 carbon atoms and are linear chain, branched or cyclic alkyl groups, alkenyl groups or alkynyl groups.

The aromatic groups represented by $R_{c1}$ are single ring or double ring aryl groups, for example phenyl group or naphthyl group.

The heterocyclic groups represented by $R_{c1}$ are from three- to ten-membered saturated or unsaturated heterocyclic groups which contain at least one species from among N, O and S atoms, and they may be single rings or they may form condensed rings with other aromatic or heterocyclic rings. The five- or six-membered aromatic heterocyclic rings are preferred as heterocyclic rings. For example, those which contain a pyridyl group, an imidazolyl group, a quinolinyl group, a benzimidazolyl group, a pyrimidyl group, a pyrazolyl group, an isoquinolinyl group, a thiazolyl group or a benzthiazolyl group are preferred.

$R_{c1}$ may be substituted with substituent groups. The groups indicated below can be cited as such substituent groups. These groups may be further substituted.

For example, the substituent groups may be alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxy groups, halogen atoms, cyano groups, sulfo groups or carboxyl groups, alkyl or aryl oxycarbonyl groups, acyl groups, alkoxycarbonyl groups, acyloxy groups, carboxamido groups, sulfonamido groups, nitro groups, alkylthio groups and arylthio groups.

These groups may be joined together and form rings in those cases where this is possible.

The aliphatic groups represented by $R_{c2}$ in general formula (c) preferably have 1 to 20 carbon atoms and more preferably 1 to 10 carbon atoms and are linear chain, branched or cyclic alkyl groups, alkenyl groups or alkynyl groups.

The aromatic groups represented by $R_{c2}$ are single ring or double ring aryl groups, for example phenyl group.

$R_{c2}$ may be substituted with substituent groups. The groups cited as substituent groups for $R_{c1}$ in general formula (c), for example, may be cited as such substituent groups.

Furthermore, $R_{c1}$ and $R_{c2}$ may be joined together and form a ring in those cases where this is possible.

$R_{c2}$ is preferably a hydrogen atom.

For $Y_c$ in general formula (c), —CO— or —$SO_2$— are especially desirable, and L is preferably a single bond or —$NR_{c4}$—.

The aliphatic groups represented by $R_{c4}$ in general formula (c) are linear chain, branched or cyclic alkyl groups, alkenyl groups or alkynyl groups.

The aromatic groups represented by $R_{c4}$ are single ring or double ring aryl groups, for example phenyl group.

$R_{c4}$ may be substituted with substituent groups. The groups cited as substituent groups for $R_{c1}$ in general formula (c), for example, may be cited as such substituent groups.

$R_{c4}$ is preferably a hydrogen atom.

A —CO— group is most desirable for G in general formula (2).

$R_2$ in general formula (2) represents a substituted alkyl group of which the carbon atom which is substituted by G is substituted by at least one electron attractive group. Substituted alkyl groups which are substituted with two electron attractive groups are preferred, and substituted alkyl groups which are substituted with three electron attractive groups are especially desirable.

Groups of which the Hammett's $\sigma_p$ value is at least 0.2 and the Hammett's $\sigma_m$ value is at least 0.3, for example halogen, cyano, nitro, nitroso, polyhaloalkyl, polyhaloaryl, alkyl or aryl carbonyl groups, formyl group, alkyl or aryl oxycarbonyl groups, alkylcarbonyloxy groups, carbamoyl groups, alkyl or aryl sulfinyl groups, alkyl or aryl sulfonyl groups, alkyl or aryl sulfonyloxy groups, sulfamoyl groups, phosphino groups, phosphinoxido groups, phosphonic acid ester groups, phosphonic acid amido groups, arylazo groups, amidino groups, ammonio groups, sulfonio groups and electron deficient heterocyclic groups are preferred as the electron attractive groups which are substituted on the carbon atom of $R_2$ on which G is substituted.

$R_2$ in general formula (2) most desirably represents a trifluoromethyl group.

$R_1$ and $R_2$ in general formula (2) may contain a ballast group or polymer as is normally used in immobile photographically useful additives such as couplers for example. A ballast group in a comparatively inert group in terms of photographic properties which has a carbon number of at least 8. Such groups can be selected, for example, from among the alkyl groups, alkoxy groups, phenyl groups, alkylphenyl groups, phenoxy groups and alkylphenoxy groups. Furthermore, the polymer disclosed, for example, in JP-A-1-100530, can be cited as an example of a polymer.

$R_1$ and $R_2$ of formula (2) do not contain a silver halide adsorptive group.

Compounds according to general formula which can be used in this invention are indicated below, but the invention is not limited to these compounds.

2-1

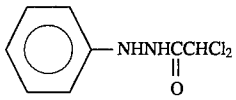

2-2

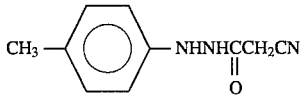

2-3

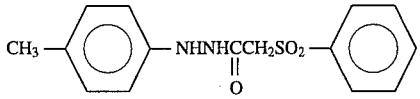

2-4

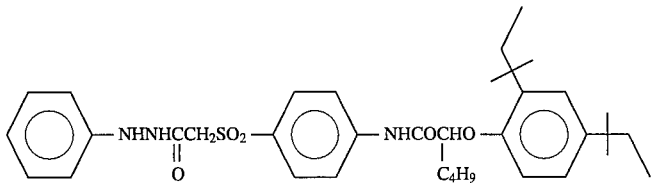

2-5

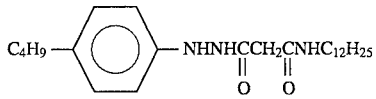

2-6

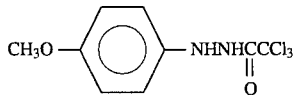

2-7

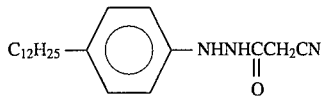

2-8

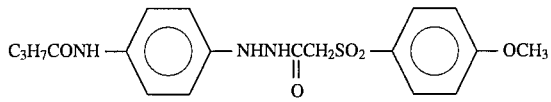

-continued
2-9
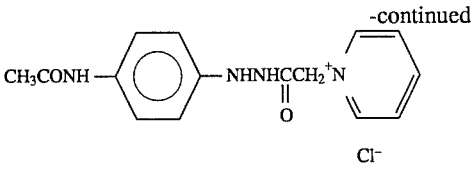
2-10
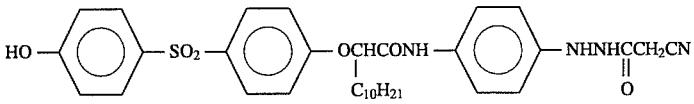
2-11
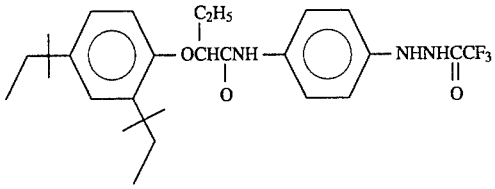
2-12
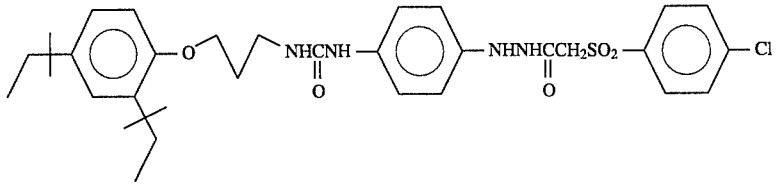
2-13
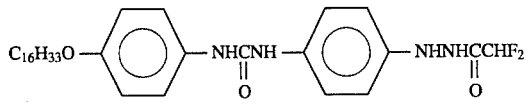
2-14
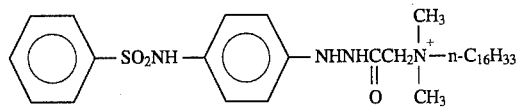
2-15
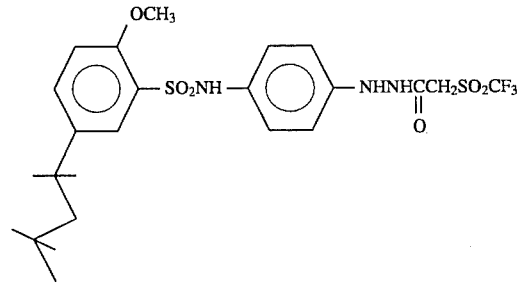
2-16
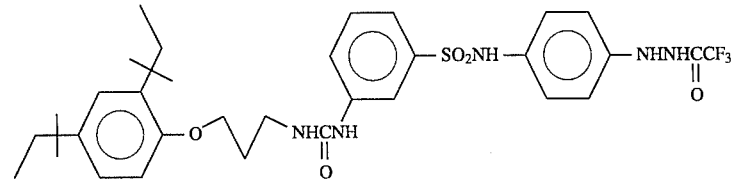
2-17
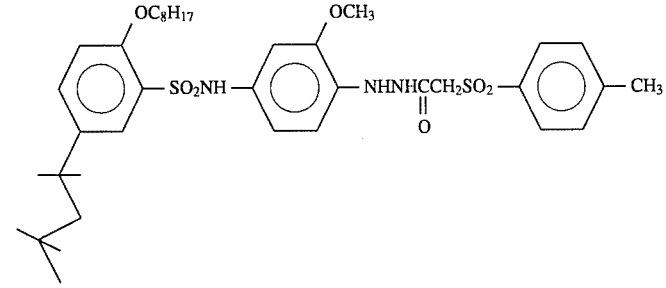

-continued
2-18
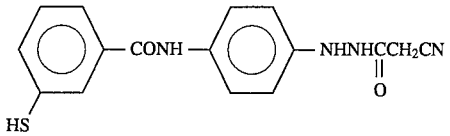
2-23
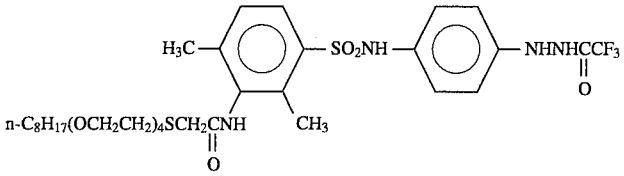
2-24
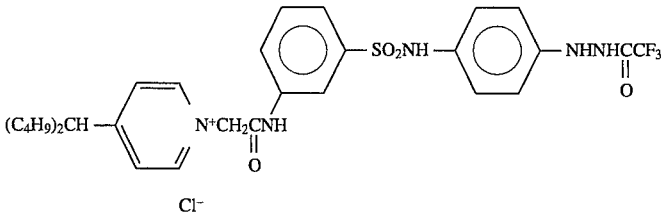
2-25
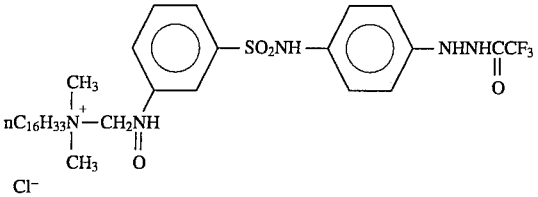
2-26
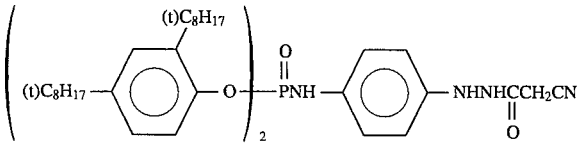
2-27
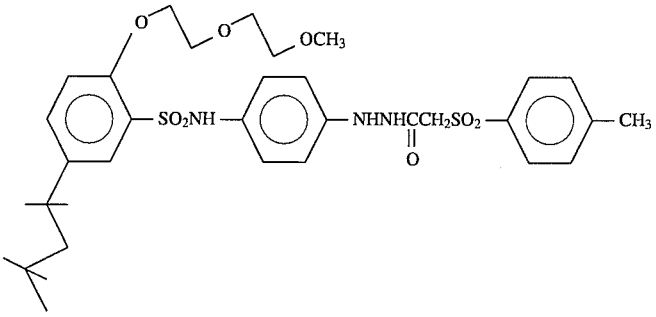
2-29
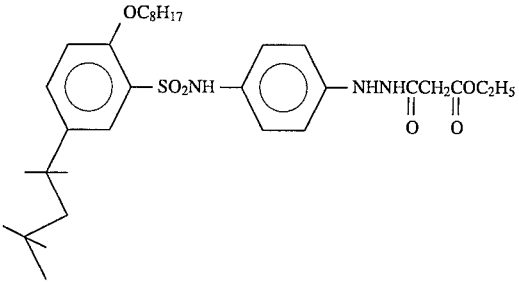
2-30
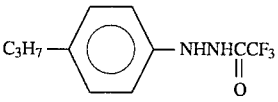

-continued
2-31
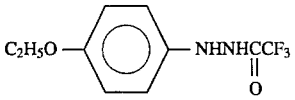
2-32
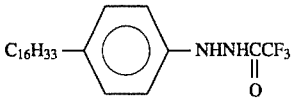
2-33
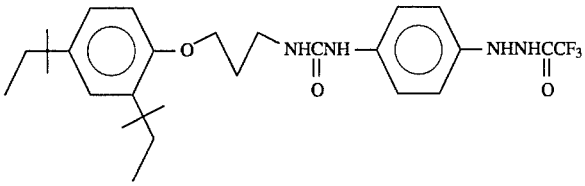
2-34
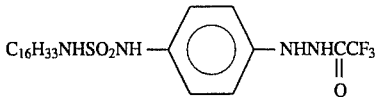
2-35
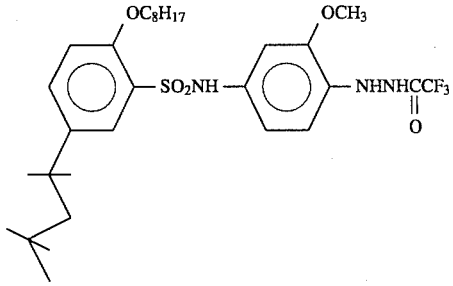
2-36
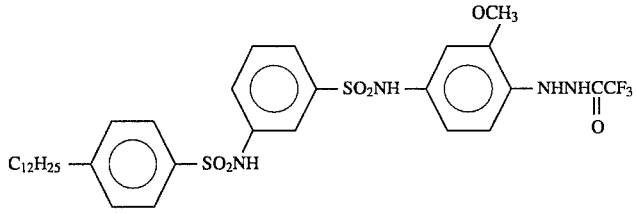
2-37
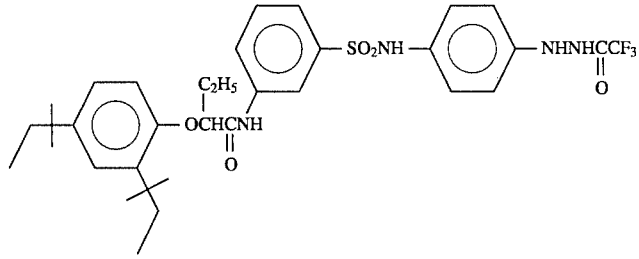
2-38
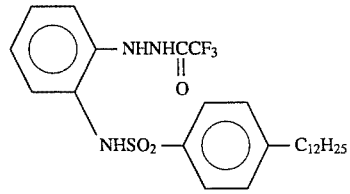
2-39
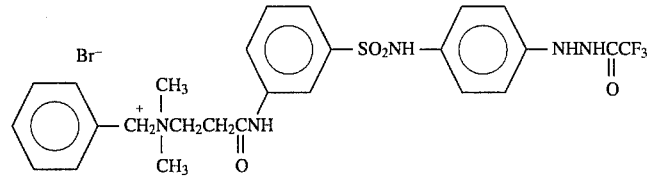

-continued 2-41

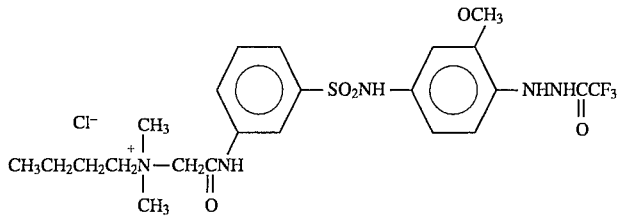

2-42

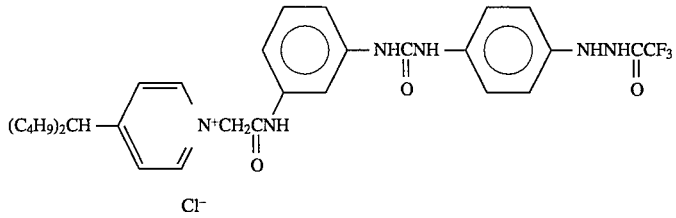

The compounds of general formula (3) are described in detail below.

In general formula (3), the aliphatic groups represented by $R_a$ preferably have 1 to 20 carbon atoms and more preferably 1 to 10 carbon atoms, and are linear chain, branched or cyclic alkyl groups, alkenyl groups or alkynyl groups.

The aromatic groups represented by $R_a$ are single ring or double ring aryl groups, for example phenyl group or naphthyl group.

The heterocyclic groups represented by $R_a$ are from three- to ten-membered saturated or unsaturated heterocyclic groups which contain at least one species from among N, O and S atoms, and they may be single rings or they may form condensed rings with other aromatic or heterocyclic rings. The five- or six-membered aromatic heterocyclic rings are preferred as heterocyclic rings. For example, those which contain a pyridyl group, an imidazolyl group, a quinolinyl group, a benzimidazolyl group, a pyrimidyl group, a pyrazolyl group, an isoquinolinyl group, a thiazolyl group or a benzthiazolyl group are preferred.

$R_a$ may be substituted with substituent groups. The groups indicated below can be cited as such substituent groups. These groups may be further substituted.

For example, the substituent groups may be alkyl groups, aralkyl groups, alkoxy groups, aryl groups, substituted amino groups, acylamino groups, sulfonamino groups, ureido groups, urethane groups, aryloxy groups, sulfamoyl groups, carbamoyl groups, aryl groups, alkylthio groups, arylthio groups, sulfonyl groups, sulfinyl groups, hydroxy groups, halogen atoms, cyano groups, sulfo groups or carboxyl groups.

These groups may be joined together and form rings in those cases where this is possible.

An aromatic group is preferred for $R_a$, and an aryl group is especially desirable.

In those cases where $G_1$ is a carbonyl group, the hydrogen atom, alkyl groups (for example, methyl, trifluoromethyl, 3-hydroxypropyl, 3-methanesulfonamidopropyl), aralkyl groups (for example, o-hydroxybenzyl) and aryl groups (for example, phenyl, 3,5-dichlorophenyl, o-methanesulfonamidophenyl, 4-methanesulfonylphenyl), for example, are preferred from among the groups which can be represented by $R_b$.

Furthermore, when $G_1$ is a sulfonyl group, $R_b$ is preferably, for example, an alkyl group (for example, methyl), an aralkyl group (for example, o-hydroxyphenylmethyl), an aryl group (for example, phenyl) or a substituted amino group (for example, dimethylamino).

When $G_1$ is a sulfoxy group, $R_b$ is preferably a cyanobenzyl group or a methylthiobenzyl group for example, and when $G_1$ is a phosphoryl group $R_b$ is preferably a methoxy group, an ethoxy group, a butoxy group, a phenoxy group or a phenyl group, and ideally it is a phenoxy group.

When $G_1$ is an N-substituted or unsubstituted iminomethylene group, $R_b$ is preferably a methyl group, an ethyl group or a substituted or unsubstituted phenyl group.

Aliphatic groups represented by $R_b$ disclosed above have preferably 1 to 20 carbon atoms and more preferably 1 to 10 carbon atoms.

The unsubstituted groups cited in connection with $R_a$, and also, for example, acyl groups, acyloxy groups, alkyl or aryl oxycarbonyl groups, alkenyl groups, alkynyl groups and nitro groups, can also be used as substituent groups for $R_b$.

These substituent groups may be further substituted with substituent groups. Furthermore, these groups may be joined together and form rings in those cases where this is possible.

The groups which promote adsorption on silver halide which can be substituted into $R_a$ or $R_b$ can be represented by $X_1$—$(L_1)_q$—.

Here, $X_1$ is a group which promotes adsorption on silver halide and $L_1$ is a divalent linking group. Moreover, q is 0 or 1.

Thioamido groups, mercapto groups, groups which have a disulfide bond and five- or six-membered nitrogen containing heterocyclic groups can be cited as preferred examples of groups which promote adsorption onto silver halide which can be represented by $X_1$.

The thioamido groups which promote adsorption represented by $X_1$ are divalent groups which can be represented by —CS-amino-, and they may be part of a ring structure or they may take the form of a non-cyclic thioamido group. Useful thioamido adsorption promoting groups can be selected from among those disclosed, for example, in U.S. Pat. Nos. 4,030,925, 4,031,127, 4,080,207, 4,245,037, 4,255,511, 4,266,013 and 4,276,364 and in *Research Disclosure* Vol. 151, No, 15162, (November 1976) and *Research Disclosure* Vol. 176, No. 17626, (December 1978).

Actual examples of non-cyclic thioamido groups include thioureido groups, thiourethane groups and dithiocarbamic acid ester groups, and actual examples of cyclic thioamido groups include 4-thiazoline-2-thione, 4-imidazoline-2-thione, 2-thiohydantoin, rhodanine, thiobarbituric acid, tetrazoline-5-thione, 1,2,4-triazolne-3-thione, 1,3,4-thiadiazoline-2-thione, 1,3,4-oxadiazoline-2-thione, benzimidazoline-2-thione, benzoxazoline-2-thione and benzothiazoline-2-thione, and these groups may be further substituted.

Aliphatic mercapto groups, aromatic mercapto groups and heterocyclic mercapto groups (in a case where there is a nitrogen atom adjacent to the carbon atom to which the —SH group is bonded, is the same as the cyclic thioamido group to which it is related tautomerically, and actual examples of such groups are the same as those listed above) can be cited as mercapto groups for $X_1$.

Five- or six-membered nitrogen containing heterocyclic groups comprised of nitrogen, oxygen, sulfur and/or carbon can be cited as five or six membered nitrogen containing heterocyclic groups which can be represented by $X_1$. Preferred examples from among these groups include benzotriazole, triazole, tetrazole, indazole, benzimidazole, imidazole, benzothiazole, thiazole, benzoxazole, oxazole, thiadiazole, oxadiazole and triazine. These may be substituted further with appropriate substituent groups.

The groups described as substituent groups for $R_a$ can be cited as such substituent groups.

From among the groups which can be represented by $X_1$, the cyclic thioamido groups (which is to say, mercapto substituted nitrogen containing heterocyclic groups, for example 2-mercaptothiadiazole, 3-mercapto-1,2,4-triazole, 5-mercaptotetrazole, 2-mercapto-1,3,4-oxadiazole and 2-mercaptobenzoxazole groups), or the nitrogen containing heterocyclic groups (for example, benzotriazole, benzimidazole and indazole groups) are preferred.

Furthermore, two or more $X_1$—$(L_1)_q$— groups may be substituted, and these groups may be the same or different.

An atom or group of atoms including at least one species from among C, N, S and O forms the divalent linking group which is represented by $L_1$. Actual examples include alkylene groups, alkenylene groups, alkynylene groups, arylene groups, —O—, —S—, —NH—, —N=, —CO—, —$SO_2$— (these groups may have substituent groups), either individually or in combinations.

These groups may be substituted with appropriate substituent groups.

The groups described as substituent groups for $R_a$ can be cited as substituent groups.

$A_1$ and $A_2$ are both hydrogen atoms or one is a hydrogen atom and the other represents a sulfinic acid residual group or an acyl group. The acyl groups represented by $A_1$ and $A_2$ have not more than 20 carbon atoms (preferably a benzoyl group or a benzoyl group which is substituted in such a way that the sum of the Hammett substituent group constants is at least −0.5), and include a linear chain, branched or cyclic, unsubstituted or substituted aliphatic acyl group (which has halogen atoms, ether groups, sulfonamido groups, carboxamido groups, hydroxy groups, carboxy groups, or sulfonic acid groups, for example, as substituent groups). The sulfinic acid residual groups represented by $A_1$ and $A_2$ are represented in practice by those disclosed in U.S. Pat. No. 4,478,928.

Hydrogen atoms are most desirable for $A_1$ and $A_2$.

A carbonyl group is most desirable for $G_1$ in general formula (3).

Of the compounds which can be represented by general formula (3), those which can be represented by general formula (3-a) are preferred.

General Formula (3-a)

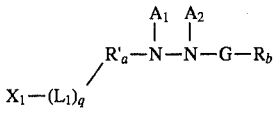

In this formula, $R'_a$ is derived by the removal of one hydrogen atom from $R_a$ in general formula (3). Here, at least one out of $R'_a$, $R_b$ and $L_1$ has an amino group or a group which can dissociate into an anion of a pKa value of at least 6.

Of the groups which can dissociate into an anion of a pKa value of at least 6, the substituent groups which can dissociate into an anion of a pKa value of 8 to 13 are preferred, and there is no need to specify these groups provided that they are virtually undissociated in neutral or weakly acidic media and dissociate satisfactorily in aqueous alkali solutions such as developers (preferably of pH 10.5 to 12.3).

For example, a hydroxy group, a group represented by —$SO_2$NH—, hydroxyimino groups, active methylene groups and active methine groups (for example, —$CH_2$COO—, —$CH_2$CO—, —CH(CN)—COO—) and similar groups can be cited.

Furthermore, the amino groups may be primary, secondary or tertiary amino groups, and those of which the pKa value of the conjugate acid is at least 6.0 are preferred.

$A_1$, $A_2$, $G_1$, $R_b$, $L_1$, $X_1$ and q have the same significance as described in connection with general formula (3).

From among those compounds which can be represented by general formula (3), those which can be represented by general formula (3-b) are especially desirable.

General Formula (3-b)

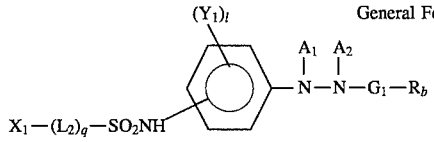

In this formula, $L_2$ is the same as $L_1$ in general formula (3-a), $Y_1$ is the same as the substituent groups cited for $R_1$ in general formula (1), q is 0 or 1, l is 0, 1 or 2, and when l is 2 the $Y_1$ groups may be the same or different.

$A_1$, $A_2$, $G_1$, $R_b$, $L_1$ and $X_1$ are the same as those described in connection with general formulae (3) and (3-a).

Moreover, the $X_1$—$(L_2)_q$—$SO_2$NH group is preferably substituted at a position para to the hydrazino group.

The compounds of general formula (3) can be synthesized on the basis of the methods disclosed, for example, in JP-A-56-67843, JP-A-60-179734 and Japanese Patent Application Nos. 60-78182, 60-111936 and 61-115036.

Actual examples of compounds which can be represented by general formula (3) are indicated below. However, the invention is not limited to the compounds below.

Compound 3-1
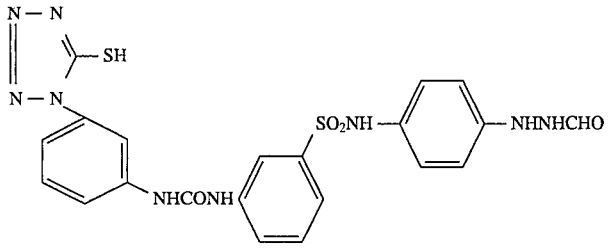
Compound 3-2
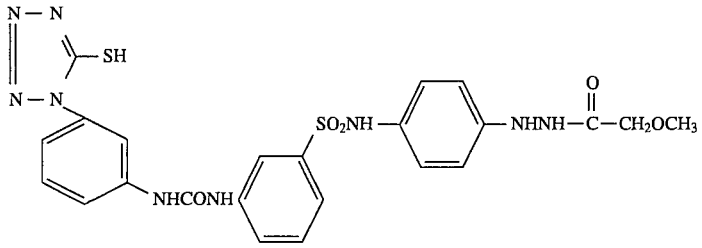
Compound 3-3
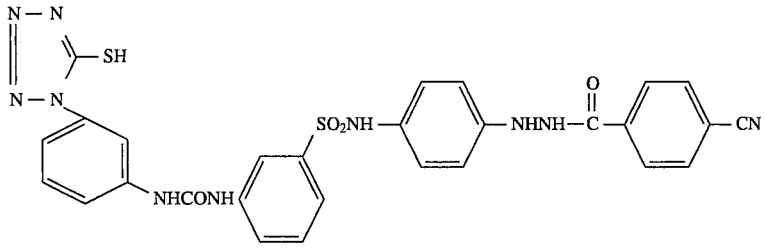
Compound 3-4
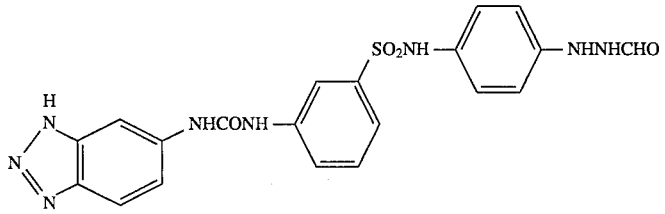
Compound 3-5
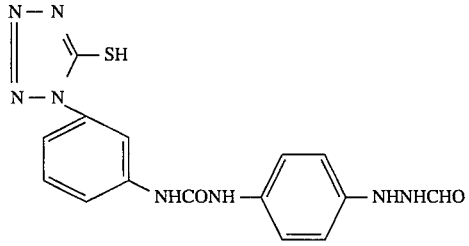
Compound 3-6
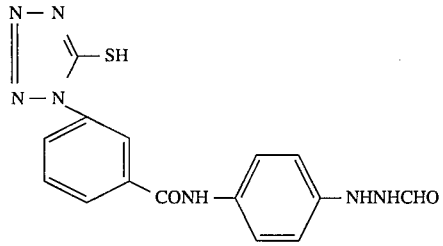

-continued

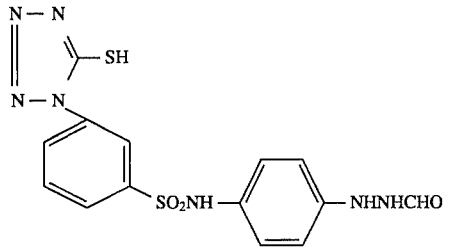

Compound 3-7

The amount of hydrazine derivative added in this invention is preferably $1\times10^{-6}$ mol to $5\times10^{-2}$ mol, and most desirably from $1\times10^{-5}$ to $2\times10^{-2}$ mol, per mol of silver halide.

The hydrazine derivatives of this invention can be dissolved for addition to the photographic material of the invention in an appropriate water miscible organic solvent, such as, for example, an alcohol (methanol, ethanol, propanol, fluorinated alcohol), a ketone (acetone, methyl ethyl ketone), dimethylformamide, dimethylsulfoxide or methylcellosolve.

Furthermore, they can be prepared for addition by dissolution in an oil such as dibutyl phthalate, tricresyl phosphate, glyceryl triacetate or diethyl phthalate for example, using an auxiliary solvent such as ethyl acetate or cyclohexanone, followed by mechanical emulsification and dispersion in accordance with the already well known emulsification and dispersion procedure. Alternatively, they can be used by dispersing the powdered hydrazine compound in water using a ball mill or a colloid mill, or by ultrasonic means, in accordance with the method known as the solid dispersion method.

The silver halides used in the silver halide emulsions which are used in the silver halide photographic photosensitive materials of this invention are silver chlorobromides and silver iodochlorobromides which contain at least 50 mol % silver chloride The silver iodide content is not more than 3 mol %, preferably not more than 0.5 mol %. The silver halide grains may have a cubic, tetradecahedral, octahedral, amorphous or plate-like form, but a cubic form is preferred. The average grain size of the silver halide is preferably 0.1 μm to 0.7 μm, and most desirably 0.2 μm to 0.5 μm. In terms of the grain size distribution, a narrow grain size distribution such that the variation coefficient which is represented by the expression {(standard deviation of the grain size)/(average grain size)}×100 is not more than 15%, and preferably not more than 10%, is desirable.

The silver halide grains may be such that the interior and the surface layer are comprised of a uniform layer, or the interior and the surface layer may be comprised of different layers.

The photographic emulsions which are used in this invention can be prepared using the methods described, for example, by P. Glafkides in *Chimie et Physique Photographique* (Paul Montel, 1967), by G. F. Duffin in *Photographic Emulsion Chemistry* (The Focal Press, 1966), and by V. L. Zelikman et al. in *Making and Coating Photographic Emulsions* (The Focal Press, 1964).

The method by which the soluble silver salt and the soluble halogen salt are reacted together may be a single-sided mixing method, a simultaneous mixing method or a combination of such methods.

Methods in which the grains are formed in the presence of an excess of silver ion (the so-called reverse mixing methods) can also be used. The method in which the pAg value in the liquid phase in which the silver halide is being formed is held constant, which is to say the controlled double jet method, can be used as one type of simultaneous mixing method. Grain formation is preferably carried out using a so-called silver halide solvent such as ammonia, thioether or tetra-substituted thiourea for example. The tetra-substituted thiourea compounds are especially desirable, and these compounds have been disclosed in JP-A-53-82408 and JP-A-55-77737. The preferred thiourea compounds are tetramethylthiourea and 1,3-dimethyl-2-imidazolidinethione.

The formation of silver halide emulsions which have a regular crystalline form and a narrow grain size distribution can be accomplished easily using the controlled double jet method with grain formation in the presence of a silver halide solvent. This is an effective means of preparing the silver halide emulsions which are used in this invention.

Furthermore, on using the method in which the rate of addition of the silver nitrate and alkali halide is varied in accordance with the rate of grain growth, as disclosed in British Patent 1,535,016, JP-B-48-36890 and JP-B-52-16364, or the method in which the concentrations of the aqueous solutions are varied, as disclosed in British Patent 4,242,445 and JP-A-55-158124, in order to provide a uniform grain size, rapid growth in the range not exceeding the critical saturation is preferred. (The term "JP-B" as used herein signifies an "examined Japanese patent publication".)

Rhodium compounds are included in a silver halide photographic photosensitive material of this invention in order to achieve a high contrast and a low fog level.

Water soluble rhodium compounds can be used for the rhodium compounds in this invention. For example, rhodium(III) halide compounds, or compounds which have halogen, amines or oxalato, for example, as ligands in a rhodium complex salt, for example hexachlororhodium(III) complex salts, hexabromorhodium(III) complex salts, hexa-amminerhodium(III) complex salts and trioxalatorhodium(III) complex salts can be used. These rhodium compounds can be dissolved in an appropriate solvent for use, or the methods generally used to stabilize solutions of rhodium compounds, which is to say the methods in which aqueous hydrogen halide solutions (for example, hydrochloric acid, hydrobromic acid, hydrofluoric acid) or alkali halides (for example KCl, NaCl, KBr and NaBr) are added, can be used. The addition and dissolution of separate silver halide grains which have been pre-doped with rhodium during the preparation of the silver halide can also be carried out instead of using water soluble rhodium compounds.

An appropriate total amount of rhodium compound added in this invention is $1\times10^{-8}$ to $5\times10^{-6}$ mol per mol of silver halide which is formed ultimately, and an amount of $5\times10^{-8}$ to $1\times10^{-6}$ mol per mol of silver halide is preferred.

The addition of these compounds can be made appropriately at any stage during the manufacture of the silver halide emulsion grains and before coating the emulsion, but addition during the formation of the emulsion, to be incorporated into the silver halide grains is preferred.

Iridium compounds may be included in a silver halide photographic photosensitive material of this invention in order to achieve a high photographic speed and high contrast.

Various iridium compounds can be used in this invention, and examples include hexachloroiridium, hexa-ammine-iridium, trioxalatoiridium and hexacyanoiridium. These iridium compounds can be dissolved in an appropriate solvent for use, or the methods generally used to stabilize solutions of iridium compounds, which is to say the methods in which aqueous hydrogen halide solutions (for example, hydrochloric acid, hydrobromic acid, hydrofluoric acid) or alkali halides (for example KCl, NaCl, KBr and NaBr) are added, can be used. The addition and dissolution of separate silver halide grains which have been pre-doped with iridium during the preparation of the silver halide can also be carried out instead of using water soluble rhodium.

An appropriate total amount of iridium compound added in this invention is $1\times10^{-8}$ to $5\times10^{-6}$ mol per mol of silver halide which is formed ultimately, and an amount of $5\times10^{-8}$ to $1\times10^{-6}$ mol per mol of silver halide is preferred.

The addition of these compounds can be made appropriately at any stage during the manufacture of the silver halide emulsion grains and before coating the emulsion, but addition during the formation of the emulsion to be incorporated into the silver halide grains is preferred.

Metal atoms, such as atoms of iron, cobalt, nickel, ruthenium, palladium, platinum, thallium, copper, lead or osmium for example, may be included in the silver halide grains which are used in this invention. The above-mentioned metals are preferably included in amounts of $1\times10^{-9}$ to $1\times10^{-4}$ mol per mol of silver halide. Furthermore, the above-mentioned metals can be included by addition in the form of simple metal salts, compound metal salts or metal complex salts during the preparation of the grains.

The silver halide emulsions of this invention are preferably chemically sensitized emulsions. The known methods such as sulfur sensitization, selenium sensitization, tellurium sensitization and precious metal sensitization, for example, can be used as methods of chemical sensitization, and these methods can be used individually or in combinations. In those cases where combinations of these methods are used, the methods of sulfur sensitization and gold sensitization, sulfur sensitization, selenium sensitization and gold sensitization, and sulfur sensitization, tellurium sensitization and gold sensitization, for example, are preferred.

The sulfur sensitization used in this invention is generally carried out by adding a sulfur sensitizing agent and then stirring the emulsion for a fixed period of time at an elevated temperature of at least 40° C. The known compounds can be used as sulfur sensitizing agents. For example, in addition to the sulfur compounds which are included in gelatin, use can be made of various sulfur compounds such as thiosulfate, thioureas, thiazoles and rhodanines. The preferred sulfur compounds are thiosulfate and thiourea compounds. The amount of sulfur sensitizing agent which is added varies according to the pH during chemical ripening, the temperature and the size of the silver halide grains. For example, but it is within the range $10^{-7}$ to $10^{-2}$ mol, and preferably within the range $10^{-5}$ to $10^{-3}$ mol, per mol of silver halide.

The known compounds can be used for the selenium sensitizing agents which are used in this invention. That is to say, in general, sensitization is carried out by adding unstable type and/or non-unstable type selenium compounds and stirring the emulsion for a fixed period of time at an elevated temperature of 40° C. or above. Use can be made of the unstable type selenium compounds disclosed, for example, in JP-B-44-15748, JP-B-43-13489 and Japanese Patent Application Nos. 2-13097, 2-229300 and 3-121798. Use of the compounds represented by general formula (VIII) and (IX) in Japanese Patent Application No. 3-121798 is especially desirable.

The tellurium sensitizing agents used in this invention are compounds which form silver telluride which promotes the formation of sensitization nuclei at the surface of, or within, the silver halide grains. Tests can be carried out using the method disclosed in Japanese Patent Application No. 4-146739 in connection with the rate of silver telluride formation in a silver halide emulsion.

In practical terms, use can be made of the compounds disclosed in U.S. Pat. Nos. 1,623,499, 3,320,069 and 3,772,031, British Patents 235,211, 1,121,496, 1,295,462 and 1,396,696, Canadian Patent 800,958, Japanese Patent Application Nos. 2-333819, 3-53693, 3-131598 and 4-129787, *J. Chem. Soc. Chem. Commun.*, 635 (1980), ibid, 1102 (1979), ibid, 645 (1979), *J. Chem. Soc. Perkin. Trans.*, 1, 2191 (1980), and in *The Chemistry of Organic Selenium and Tellunium Compounds*, Ed. S. Patai, Vol. 1 (1986) and ibid, Vol. 2 (1987). The compounds represented by general formulae (II), (III) and (IV) in Japanese Patent Application No. 4-146739 are especially desirable.

The amount of the selenium or tellurium sensitizer used in the present invention which is added varies according to the silver halide grains which are being used and the chemical ripening conditions for example, but amounts of some $10^{-8}$ to $10^{-2}$ mol, and preferably of $10^{-7}$ to $10^{-3}$ mol, per mol of silver halide, are generally used. No particular limitation is imposed upon the chemical sensitization conditions in this invention, but the pH is 5 to 8, the pAg value is 6 to 11 and preferably 7 to 10, and the temperature is 40° to 95° C. and preferably 45° to 85° C.

Gold, platinum, palladium and iridium, for example, can be cited as precious metal sensitizing agents which can be used in this invention, and gold sensitization is especially desirable. Actual examples of gold sensitizing agents which can be used in the invention include chloroauric acid, potassium aurate, potassium aurithiocyanate and gold sulfide, and an amount of some $10^{-7}$ to $10^{-2}$ mol per mol of silver halide can be used.

Cadmium salts, zinc salts, lead salts, thallium salts and the like may also be present during the formation and physical ripening of the silver halide grains in a silver halide emulsion which is used in this invention.

Reduction sensitization can be used in this invention. Stannous salts, amines, formamidine sulfinic acid and silane compounds, for example, can be used as reduction sensitizing agents.

Thiosulfonic acid compounds may be added, using the method indicated in EP-A-293917, to the silver halide emulsions of this invention.

The silver halide emulsion used in a photosensitive material of this invention may be of a single type, or two or more types (which have, for example, different average grain sizes, different halogen compositions, different crystal habits or which have been subjected to different chemical sensitization conditions) may be used conjointly.

The colloid-like silica (colloidal silica) which is used in this invention is of an average particle size from 5 mμ to 1000 mμ, and preferably from 5 mμ to 500 mμ. It has silicon dioxide as the principal component, and it may contain alumina or sodium aluminate, for example, as minor components. Furthermore, inorganic bases such as sodium hydroxide, potassium hydroxide, lithium hydroxide and ammonia for example, and organic bases such as tetramethylammonium ions, may be included, as stabilizers, in these colloidal silicas.

Colloidal silicas of this type have been disclosed in JP-A-53-112732, JP-B-57-009051 and JP-B-57-051653.

Actual examples of colloidal silicas are available commercially from Nissan Chemicals (Tokyo, Japan) under the trade names Snotex 20 ($SiO_2/Na_2O \geqq 57$), Snotex 30 ($SiO_2/Na_2O) \geqq 50$), Snotex C ($SiO_2/Na_2O \geqq 100$) and Snotex O ($SiO_2/Na_2O) \geqq 500$) for example. Here, the ratio $SiO_2/Na_2O$ represents the ratio by weight of the silicon dioxide ($SiO_2$) and sodium hydroxide contents, the sodium hydroxide being calculated as $Na_2O$, and the values given are those listed in the catalogue.

The amount of colloidal silica used in this invention in terms of the dry weight ratio with the gelatin which is used as the binder in the layer to which the silica is added is preferably from 0.05 to 1.0, and most desirably from 0.1 to 0.6.

The dynamic friction coefficient (μk) in this invention can be obtained on the basis of the same general principle as the friction coefficient test method described in JIS K7125. Thus, after being left to stand for at least 1 hour under conditions of 25° C., 60% RH, a sapphire needle (of diameter from 0.5 to 5 mm for example) is applied with a constant load (the contact force, Fp, for example 50 to 200 grams) and is slid on the surface of the silver halide photosensitive materials along at constant speed (for example, from 20 to 100 cm/min) and the dynamic friction force (Fk) at this time is measured and the dynamic friction coefficient is determined using the equation indicated below.

$$\mu k = \frac{Fk}{Fp}$$

μk: Dynamic friction coefficient

Fk: Tangential force (grams)

Fp: Contact force (grams)

For example, the measurements can be made using the device for measuring surface properties (model HEIDON-14) made by Shinto Science (Co.).

So-called lubricants are preferably used to set the dynamic friction coefficient of the outermost layer to not more than 0.35 in this invention, preferably not more than 0.30 and more preferably 0.1 to 0.25.

The silicone based lubricants disclosed, for example, in U.S. Pat. Nos. 4,004,927, 4,047,958 and 3,489,567 and British Patent 1,143,118, the higher fatty acid based, alcohol based and acid amide based lubricants disclosed, for example, in U.S. Pat. Nos. 2,454,043, 2,732,305, 2,976,148 and 3,206,311 and West German Patents 1,284,295 and 1,284,294, the metal soaps disclosed, for example, in British Patent 1,263,722 and U.S. Pat. No. 3,933,516, the ester based and ether based lubricants disclosed in U.S. Pat. Nos. 2,588,765 and 3,121,060, and British Patent 1,198,387, the taurine based lubricants disclosed in U.S. Pat. Nos. 3,502, 473 and 3,042,222, and the aforementioned colloid-like silica can be cited, for example, as lubricants.

The use of the alkylpolysiloxanes which can be represented by general formula (IV), general formula (V) or general formula (VI) disclosed in JP-A-4-214551, and liquid paraffins which are in a liquid state at room temperature, is preferred for the lubricant in this invention. Moreover, the use of the alkylpolysiloxanes which have a polyoxyalkylene chain as a side chain represented by general formula (IV) and the alkylpolysiloxanes represented by general formula (V) are especially desirable.

A detailed description of the polyacrylamide derivatives which are important in the constitution of this invention is given below. The polyacrylamide derivatives in this invention are polymers which have a repeating unit which can be represented by the general formula (I) below.

General Formula (I)

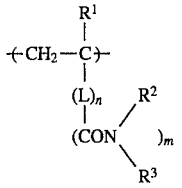

In this formula, $R^1$ represents a hydrogen atom or an alkyl group of a carbon number 1 to 6, and $R^2$ and $R^3$ each represents a hydrogen atom, a substituted or unsubstituted alkyl group of a carbon number of not more than 10, an aryl group or an aralkyl group, and they may be the same or different. Furthermore, $R^2$ and $R^3$ may be joined and, together with the nitrogen atom, form a nitrogen containing heterocyclic ring.

The preferred polymers of this invention which have repeating units which can be represented by general formula (I) are described below.

In general formula (I), $R^1$ represents a hydrogen atom or an alkyl group of a carbon number 1 to 6, and the hydrogen atom and the methyl group are preferred.

$R^2$ and $R^3$ each represents a hydrogen atom, a substituted or unsubstituted alkyl group of carbon number not more than 10, a substituted or unsubstituted aryl group or a substituted or unsubstituted aralkyl group, and they may be the same or different. A hydroxy group, lower alkoxy groups, halogen atoms, amido groups, a cyano group, sulfonic acid groups, carboxylic acid groups and such like groups can be cited as substituent groups. A hydrogen atom, a methyl group, an ethyl group or a phenyl group are preferred $R^2$ and $R^3$, and of these the hydrogen atom is the most desirable.

L represents a divalent linking group, and the alkylene groups of a carbon number 1 to 10, arylene groups or divalent groups in which such groups are combined with ether bonds, ester bonds or amido bonds, for example, can be cited as examples of such groups.

Moreover, n represents 0 or 1, preferably 0.

Moreover, m represents 1 or 2, preferably 1.

Actual examples of preferred monomers from among the ethylenic unsaturated monomers with which the repeating units represented by general formula (I) are constructed are indicated below.

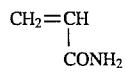

I-1

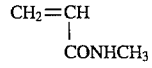

I-2

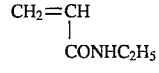

I-3

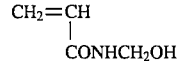

I-4

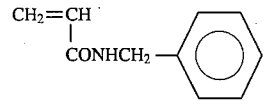

I-5

-continued

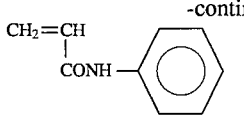

I-6

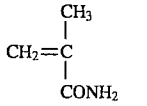

I-7

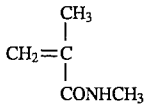

I-8

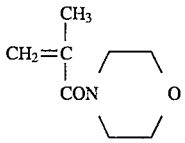

I-9

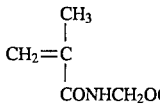

I-10

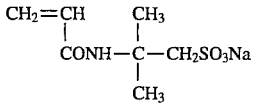

I-11

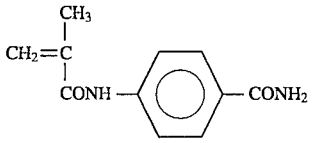

I-12

The repeating unit which is represented by general formula (I) may contain two or more types of monomer in order to realize a complex function as a polymer.

The macromolecular polymer in this invention is a compound represented by general formula (II) below which contains as a polymer structural unit at least 70 mol %, preferably at least 80 mol %, and most desirably at least 90 mol %, of a repeating unit in polymer which can be represented by general formula (II).

General Formula (II)

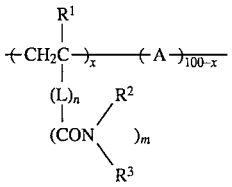

In this formula, x indicates mol percent, and x is preferably from 10 to 100, more desirably from 70 to 100, and most desirably 95 to 100.

A in the formula represents a monomer unit for which a copolymerizable ethylenically unsaturated monomer has been copolymerized.

Examples of such copolymerizable ethylenically unsaturated monomers include ethylene, propylene, 1-butene, isobutene, styrene, chloromethylstyrene, hydroxymethylstyrene, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridinium chloride, N-vinylacetamide and their alkali metal (for example sodium, potassium) salts, alkaline earth metal (for example calcium, magnesium) salts, ammonium salts and similar salts; maleic acid anhydride, maleic acid and salts thereof; vinylbenzenesulfonic acid vinylbenzylsulfonic acid, acrylamido-2-methylpropanesulfonic acid and salts thereof for example, and the gelatin reactive monomer units disclosed, for example, in JP-A-56-151937, JP-A-57-104927 and JP-A-56-142524.

Those indicated below are examples of preferred compounds of the polymers in this invention. (The numerical values for the degree of polymerization are in terms of mol %.)

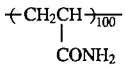

(II-1)

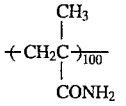

(II-2)

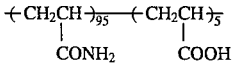

(II-3)

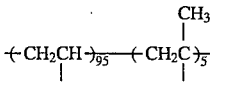

(II-4)

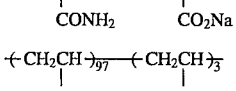

(II-5)

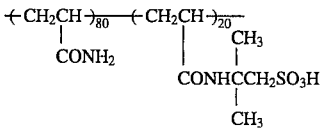

(II-6)

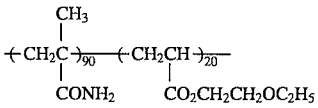

(II-7)

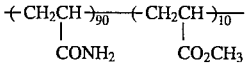

(II-8)

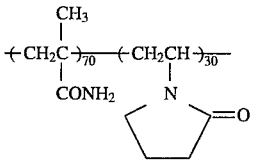

(II-9)

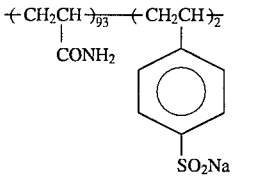

(II-10)

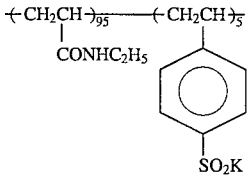

(II-11)

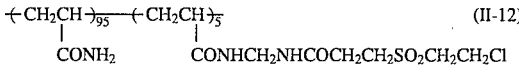

(II-12)

The polymers which have a repeating unit represented by general formula (II) which are added to the emulsion layer in this invention have a weight average molecular weight (Mw) of from 2,000 to 200,000, and preferably of from 2,000 to 50,000. Those which have an Mw of from 2,000 to 10,000 are especially desirable from the viewpoints of black spotting, abrasion and adhesion.

The sensitizing dyes which are used in the invention are preferably compounds which can be represented by the general formula (4) or the general formula (5) or the general formula (6) indicated below.

General Formula (4)

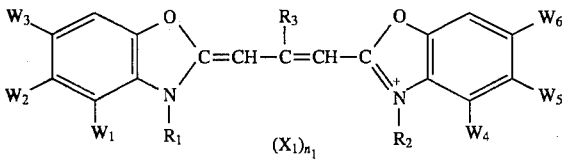

In general formula (4), $W_1$ and $W_4$ represent hydrogen atoms. $W_3$ and $W_6$ represent hydrogen atoms, methyl groups or methoxy groups. $W_2$ is an alkyl group which may be branched of a total carbon number not more than 6 (for example, methyl, ethyl, butyl, isobutyl, hexyl, methoxyethyl), an alkoxy group which has a total carbon number of not more than 5 (for example, methoxy, ethoxy, pentyloxy, ethoxymethoxy, hydroxyethoxy), a bromine atom, an iodine atom or an aryl group of a total carbon number not more than 9 (for example, phenyl, tolyl, anisyl, chlorophenyl, carboxyphenyl), or it may be joined with $W_1$ or $W_3$ to form a benzene ring and, in cases where $W_3$ represents a methyl group or a methoxy group, $W_2$ can also represent a chlorine atom. $W_5$ represents an alkyl group which may be branched of a total carbon number not more than 6 (for example, methyl, ethyl, butyl, isobutyl, hexyl, methoxyethyl), an alkoxy group of a total carbon number not more than 5 (for example, methoxy, ethoxy, pentyloxy, ethoxymethoxy, hydroxyethoxy), a hydroxy group, a halogen atom, an aryl group of a total carbon number not more than 9 (for example, phenyl, tolyl, anisyl, chlorophenyl, carboxyphenyl), an aryloxy group of a total carbon number not more than 9 (for example, tolyloxy, anisyloxy, phenoxy, chlorophenoxy), an arylthio group of a total carbon number not more than 8 (for example, tolylthio, chlorophenylthio, phenylthio), an alkylthio group of a total carbon number not more than 4 (for example, methylthio, ethylthio, hydroxyethylthio) or an acylamino group of a total carbon number not more than 4 (for example, acetylamino, propionylamino, methanesulfonylamino), or $W_5$ may be joined with $W_4$ or $W_6$ to form a benzene ring.

$R_1$ and $R_2$ may be the same or different, representing alkenyl groups or alkyl groups, which may be substituted, of a total carbon number not more than 10, and at least one of $R_1$ and $R_2$ is a group which contains a sulfo group or a carboxyl group. More desirable substituent groups for the alkyl groups and alkenyl groups include, for example, sulfo groups, carboxyl groups, halogen atoms, hydroxy groups, alkoxy groups of a carbon number not more than 6, aryl groups which may be substituted of a carbon number not more than 8 (for example, phenyl, tolyl, sulfophenyl, carboxyphenyl), heterocyclic groups (for example, furyl, thienyl), aryloxy groups which may be substituted of a carbon number not more than 8 (for example, chlorophenoxy, phenoxy, sulfophenoxy, hydroxyphenoxy), acyl groups of a carbon number not more than 8 (for example, benzenesulfonyl, methanesulfonyl, acetyl, propionyl), alkoxycarbonyl groups of a carbon number not more than 6 (for example, ethoxycarbonyl, butoxycarbonyl), cyano groups, alkylthio groups of a carbon number not more than 6 (for example, methylthio, ethylthio), arylthio groups which may be substituted of a carbon number not more than 8 (for example, phenylthio, tolylthio), carbamoyl groups which may be substituted of a carbon number not more than 8 (for example, carbamoyl, N-ethylcarbamoyl), and acylamino groups of a carbon number not more than 8 (for example, acetylamino, methanesulfonylamino). There may be one or more than one substituent group.

Actual examples of the groups represented by $R_1$ and $R_2$include methyl, ethyl, propyl, allyl, pentyl, hexyl, methoxyethyl, ethoxyethyl, phenethyl, tolylethyl, sulfophenethyl, 2,2,2-trifluoroethyl, 2,2,3,3-tetrafluoropropyl, carbamoylethyl, hydroxyethyl, 2-(2-hydroxyethoxy)ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropyloxy)ethyl and 2-[2-(3-sulfopropyloxy)ethoxy]ethyl groups.

$R_3$ represents a lower alkyl group preferably having 1 to 10 carbon atoms and more preferably 1 to 5 carbon atoms, which may be substituted (for example, methyl, ethyl, propyl, methoxyethyl, benzyl, phenethyl).

$X_1$ represents a counter ion which is required to neutralize the charge.

Moreover, $n_1$ represents 0 or 1, and it is 0 when an intramolecular salt is formed.

The sensitizing dyes of general formula (5) are described in detail below.

General Formula (5)

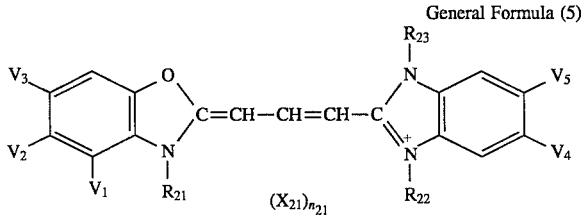

In this formula, $V_1$ represents a hydrogen atom. $V_2$ represents a hydrogen atom, a lower alkyl group which may be branched (preferably of a total carbon number not more than 6, for example, methyl, ethyl, butyl, isobutyl, hexyl, methoxyethyl), a lower alkoxy group (preferably of a total carbon number not more than 5, for example, methoxy, ethoxy, pentyloxy, ethoxymethoxy, hydroxyethoxy), a hydroxy group, a halogen atom, an aryl group of total carbon number not more than 9 (for example, phenyl, a tolyl, anisyl, chlorophenyl, carboxyphenyl), an aryloxy group of a total carbon number not more than 9 (for example, tolyloxy, anisyloxy, phenoxy, chlorophenoxy), an arylthio group of a total carbon number not more than 8 (for example, tolylthio, chlorophenylthio, phenylthio), an alkylthio group of a total carbon number not more than 4 (for example, methylthio, ethylthio, hydroxyethylthio) or an acylamino group of a total carbon number not more than 4 (for example, acetylamino, propionylamino, methanesulfonylamino), or it may be joined with $V_1$ or $V_3$ to form a benzene ring. $V_3$ represents a hydrogen atom, a methyl group or a methoxy group.

$V_4$ represents an electron attractive group. Halogen atoms, lower perfluoroalkyl groups (preferably of a total carbon number not more than 5, for example, trifluoromethyl, 2,2,2-trifluoroethyl, 2,2,3,3-tetrafluoropropyl), acyl groups (preferably of a total carbon number not more than 8, for example, acetyl, propionyl, benzoyl, mesityl and benzenesulfonyl), alkylsulfamoyl groups (preferably of a total carbon number not more than 5, for example, methylsulfamoyl, ethylsulfamoyl), a carboxyl group, alkylcarbonyl groups (preferably of a total carbon number not more than 5, for example methoxycarbonyl, ethoxycarbonyl, butoxycarbonyl) and a cyano group, for example, can be cited as preferred electron attractive groups. $V_5$ represents a hydrogen atom, a fluorine atom, a bromine atom or a chlorine atom.

$R_{21}$, $R_{22}$ and $R_{23}$ may be the same or different, and each represents an alkenyl group or an alkyl group which may be substituted of a total carbon number not more than 10, and at least one of $R_{21}$, $R_{22}$ and $R_{23}$ is a group which has a sulfo group or a carboxyl group.

$X_{21}$ represents a counter ion which is required to neutralize the charge.

Moreover, $n_{21}$ represents 0 or 1, and it is 0 when an intramolecular salt is formed.

General Formula (6)

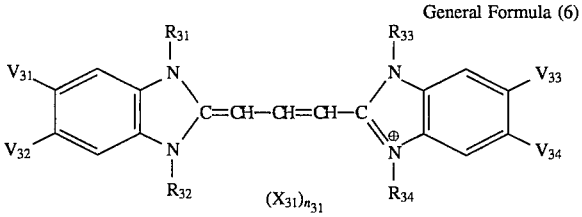

In general formula (6), $V_{31}$ and $V_{33}$ represent a hydrogen atom or an electron attractive group and $V_{32}$ and $V_{34}$ represent an electron attractive group. $R_{31}$, $R_{32}$, $R_{33}$ and $R_{34}$ may be the same or different, represent a substituted or unsubstituted alkyl group having a total carbon number of 10 or less or a substituted or unsubstituted alkenyl group having a total carbon number of 10 or less, and at least one of $R_{31}$, $R_{32}$, $R_{33}$ and $R_{34}$ have a sulfo group or carboxyl group. $X_{31}$ represents a counter ion which is required to neutralize the charge. Moreover, $n_{31}$ represents 0 or 1, and it is 0 when an intramolecular salt is formed.

The spectrally sensitizing dyes represented by general formula (4), (5) or (6) used in this invention may be dispersed directly in the emulsion or they may be dissolved in a solvent such as water, methanol, ethanol, propanol, acetone methylcellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, for example, either alone or in combinations, and added to the emulsion in order to be included in the silver halide emulsions of this invention.

Furthermore, the method in which dyes are dissolved in a volatile organic solvent, the solution is dispersed in water or hydrophilic colloid and the dispersion is added to the emulsion as disclosed, for example, in U.S. Pat. No. 3,469,987, the method in which a water insoluble dye is dispersed in a water soluble solvent in which it does not dissolve and the dispersion is added to the emulsion as disclosed, for example, in JP-B-46-24185, the method in which a dye is dissolved in acid and the solution is added to the emulsion, or in which it is present along with an acid or a base in an aqueous solution and this is added to the emulsion as disclosed, for example, in JP-B-44-23389, JP-B-44-27555 and JP-B-57-22091, the method in which an aqueous solution or a colloidal dispersion, together with surfactant, is added to the emulsion as disclosed, for example, in U.S. Pat. Nos. 3,822,135 and 4,006,025, the method in which a dye is dispersed directly in a hydrophilic colloid and the dispersion is added to the emulsion as disclosed in JP-A-53-102733 and JP-A-58-105141, and the method in which the dye is dissolved using a red-shifted compound and the solution is added to the emulsion as disclosed in JP-A-51-74624, can be used.

Furthermore, ultrasonics can be used to achieve dissolution.

The time at which the sensitizing dyes used in this invention are added to the silver halide emulsions of this invention may be at any stage during the preparation of the emulsion at which it has been seen in the past to be useful to make the addition. For example, as disclosed in U.S. Pat. Nos. 2,735,766, 3,628,960, 4,183,756 and 4,225,666, in JP-A-58-184142 and JP-A-60-196749, the addition may be made during the silver halide grain formation process or/and before de-salting, during the de-salting process and/or after the de-salting process and before the start of chemical ripening or, as disclosed in JP-A-58-113920, the addition can be made immediately before or during the process of chemical ripening, or at any stage after chemical ripening before the emulsion is coated. Furthermore, as disclosed, for example, in U.S. Pat. Nos. 4,225,666 and JP-A-58-7629, the addition may take the form of a divided addition of the same compound alone or of a combination of compounds of different structures, with additions being made during the process of grain formation and during the chemical ripening process or after the completion of chemical ripening, or before or during chemical ripening and after the completion of chemical ripening, and the compounds which are divided and added and the various combinations of compounds can also be changed for the addition.

The sensitizing dyes used in this invention have been disclosed, for example, in JP-B-48-38406, JP-B-43-4936, JP-B-48-28293, JP-B-48-25652, JP-B-43-22884, JP-B-54-34609, JP-B-54-34610, JP-B-57-22368, JP-B-57-10418 and JP-A-50-23220, and they can be prepared on the basis of the methods disclosed in these patent specifications and in French Patents 1,108,788 and 2,174,418. In cases where this invention is applied to a silver halide emulsion, the sensitizing dyes used in the blue sensitive region and in the blue-green sensitive region disclosed, for example, in JP-A-62-15439, JP-A-62-287250, JP-A-53-71829 and U.S. Pat. No. 3,667,960 can be used conjointly with a view to widening the photosensitive wavelength. When applied to silver halide photographic photosensitive materials, in cases in which it is necessary to increase only the sensitivity of a specified wavelength region in spectral terms, the formation of aggregates of appropriate sensitizing dyes is desirable, and from among the sensitizing dyes which can be represented by the aforementioned general formulae (4), (5) and (6), those which readily form so-called J-aggregates are preferred. Furthermore, the conjoint use, for example, of the water soluble bromides, and the water soluble additives (for example, bispyridinium salt compounds, mercapto-containing heterocyclic sulfone compounds, alkali metal salts) disclosed, for example, in JP-B-49-46932, JP-A-58-28738 and U.S. Pat. No. 3,776,738 is desirable for reinforcing the J-aggregates. These compounds are used in amounts of $10^{-5}$ to 1 mol per mol of silver halide.

Examples of sensitizing dyes which can be used in this invention are indicated below, but the invention is not limited to these examples.

Examples of Sensitizing Dyes Represented by General Formula (4)
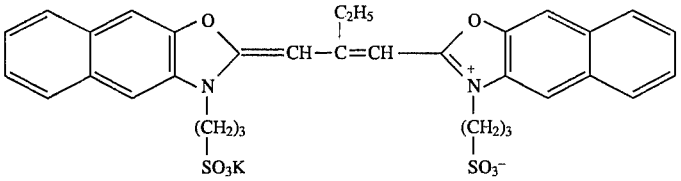
(4-A)
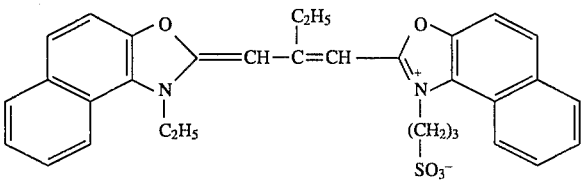
(4-B)
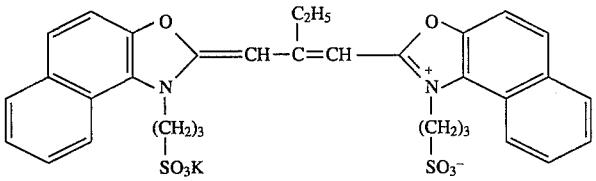
(4-C)
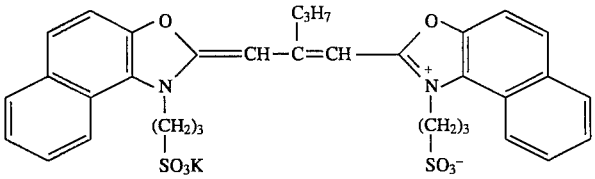
(4-D)
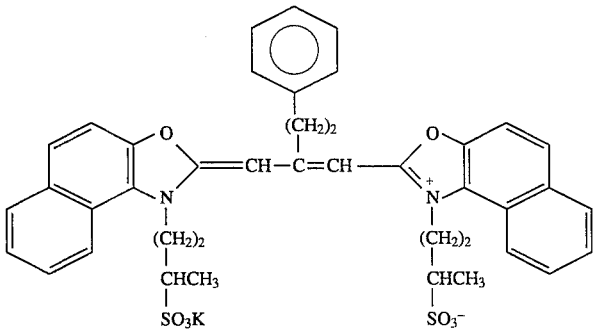
(4-E)
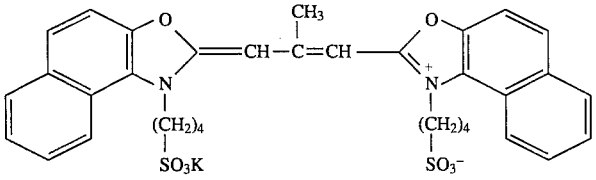
(4-F)
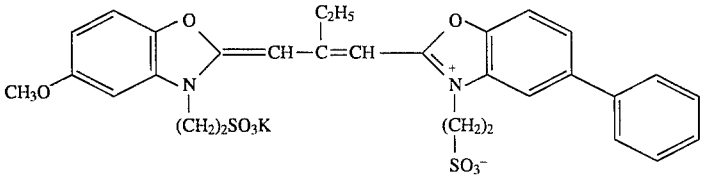
(4-G)
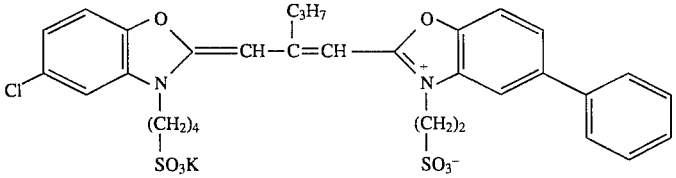
(4-H)

-continued
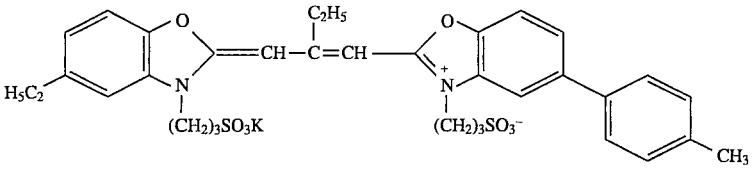
(4-I)
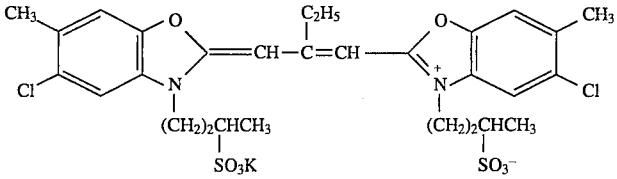
(4-J)
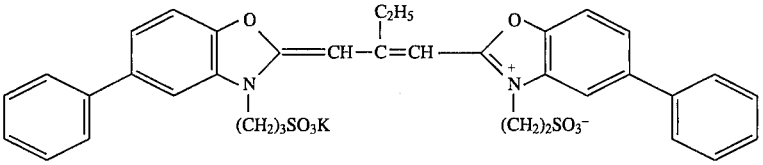
(4-K)
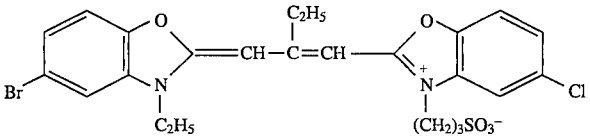
(4-L)
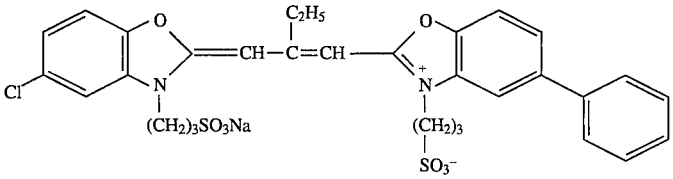
(4-M)
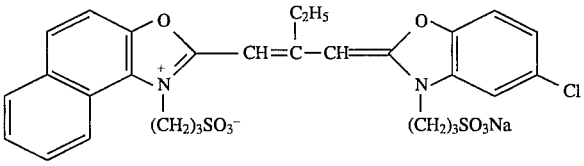
(4-N)
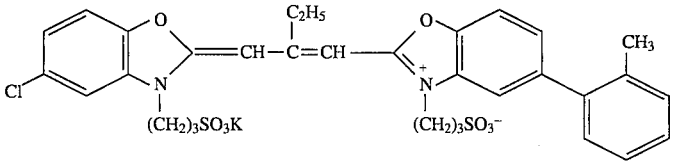
(4-O)
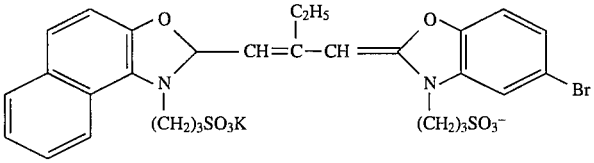
(4-P)
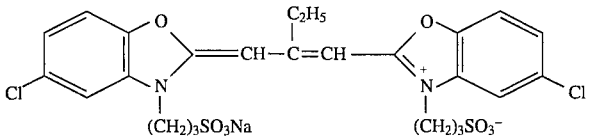
(4-Q)

-continued
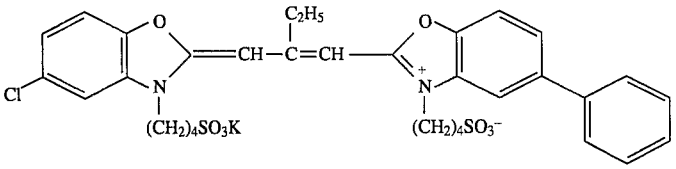
(4-R)
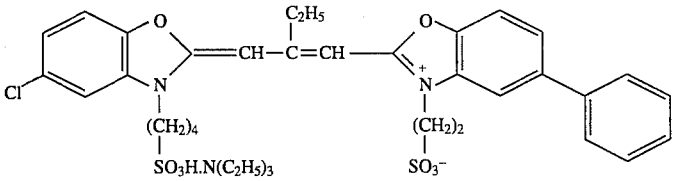
(4-S)
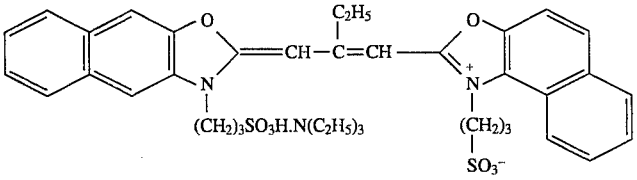
(4-T)
Examples of Sensitizing Dyes Represented by General Formula (5)
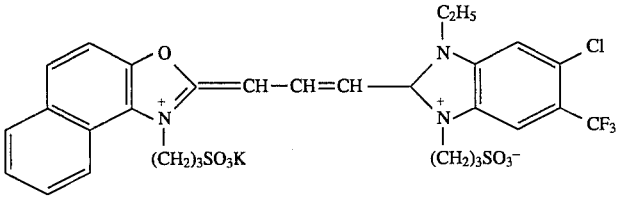
(5-A)
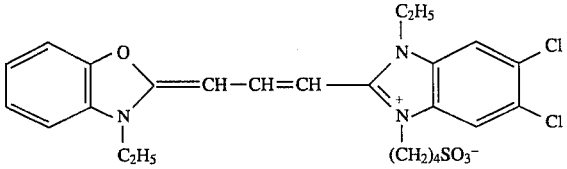
(5-B)
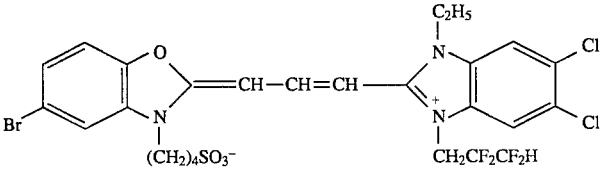
(5-C)
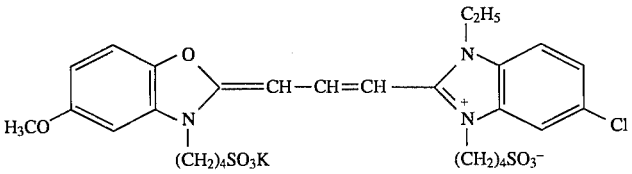
(5-O)
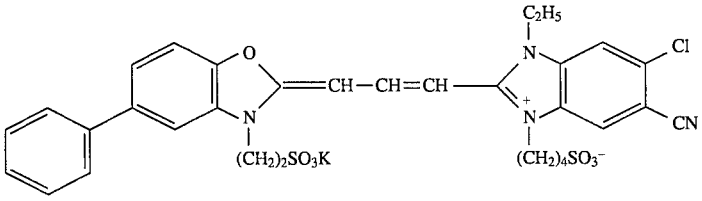
(5-E)

-continued
(5-F)
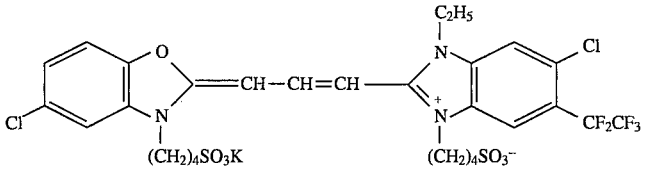
(5-G)
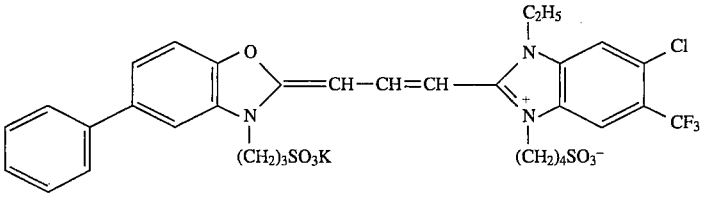
(5-H)
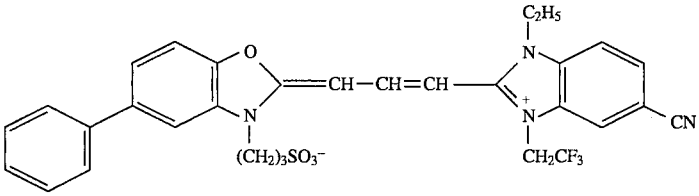
(5-I)
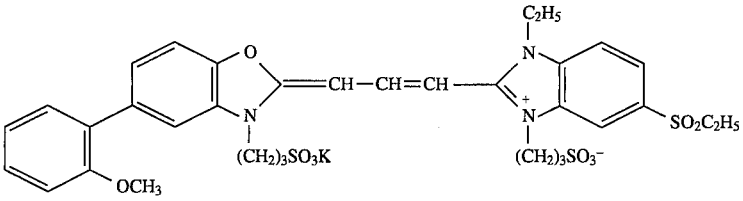
(5-J)
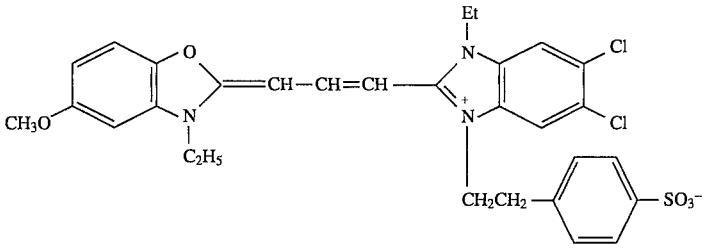
(5-K)
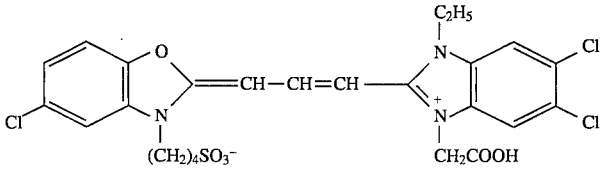
(5-L)
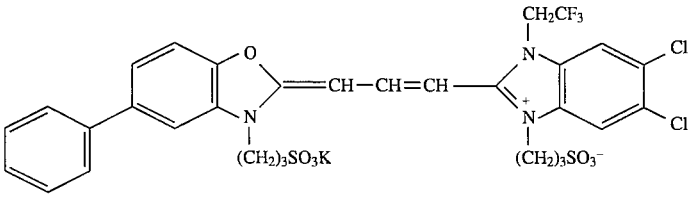
(5-M)
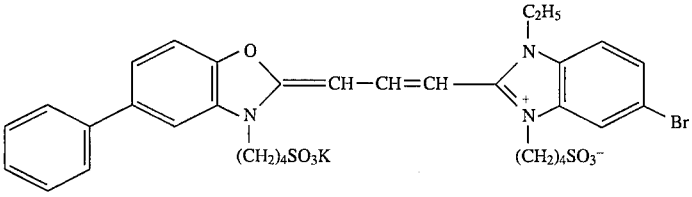

-continued
(5-N)
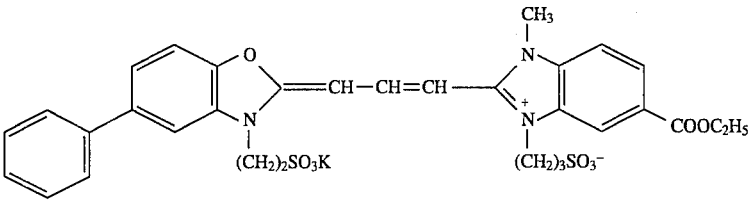
(5-O)
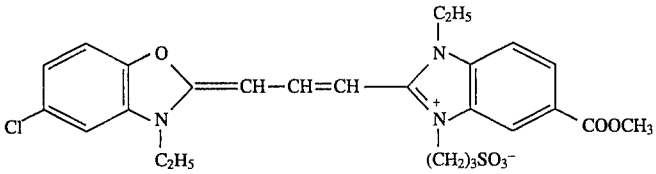
(5-P)
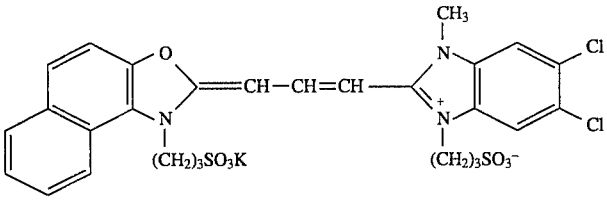
(5-Q)
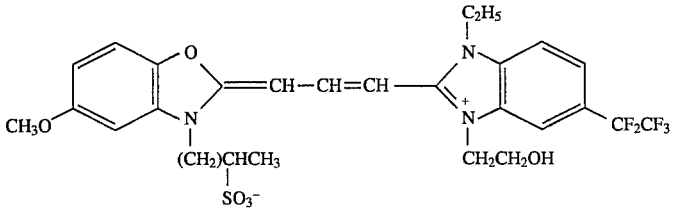
Examples of Sensitizing Dyes Represented by General Formula (6)
(6-A)
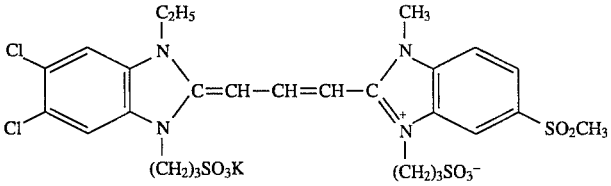
(6-B)
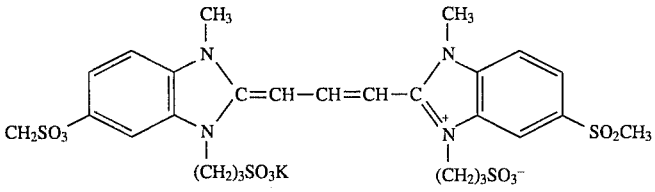
(6-C)
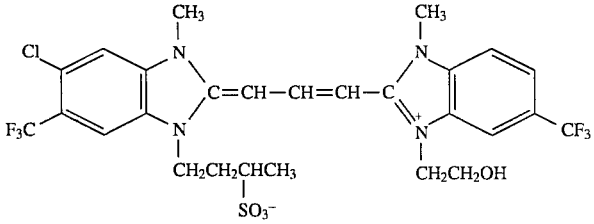
(6-D)
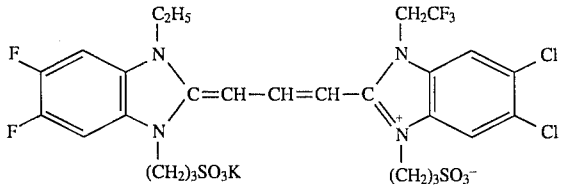

-continued
(6-E)
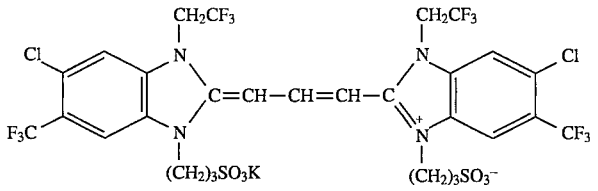
(6-F)
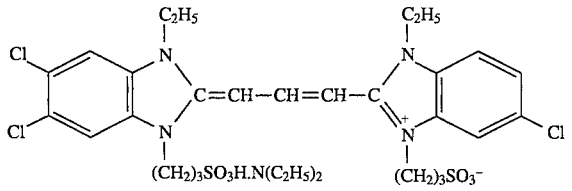
(6-G)
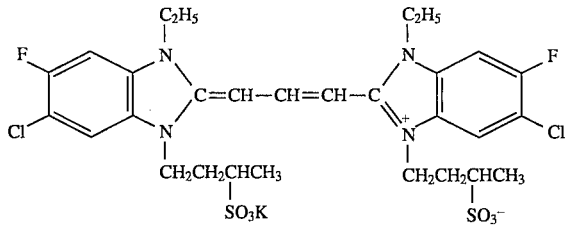
(6-H)
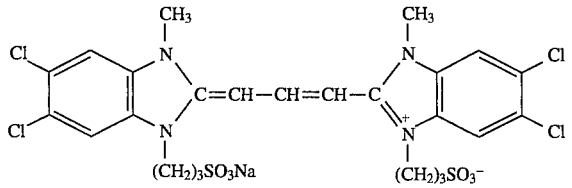
(6-I)
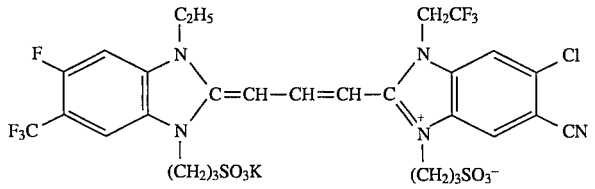
(6-J)
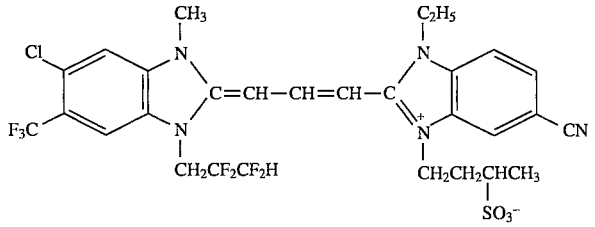
(6-K)
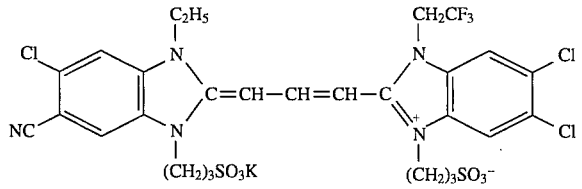
(6-L)
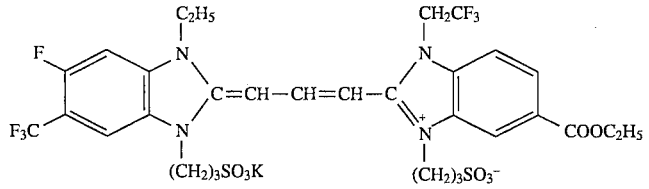

-continued
(6-M)
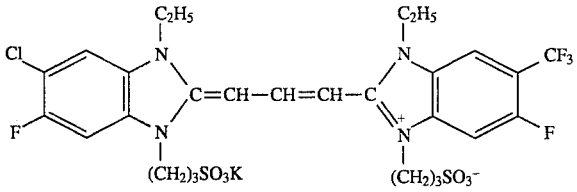
(6-N)
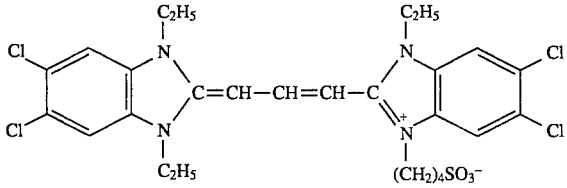
(6-O)
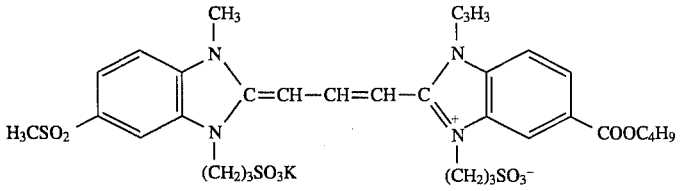
(6-P)
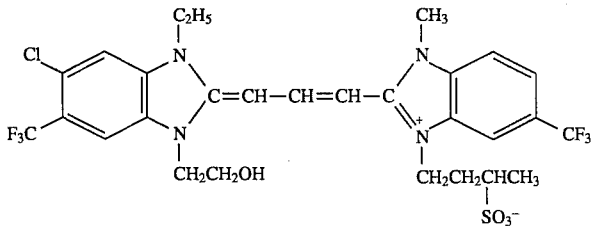
(6-Q)
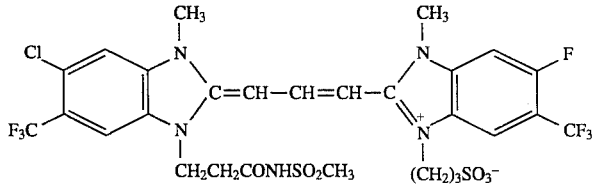
(6-R)
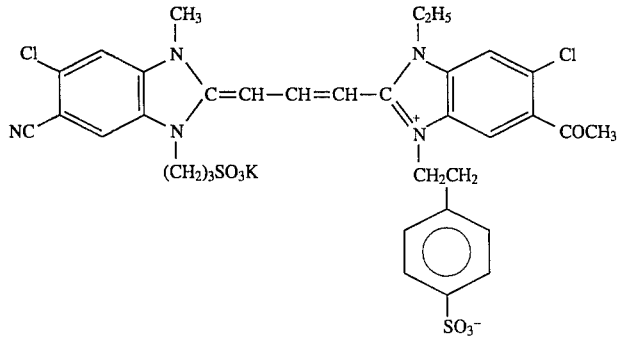
(6-S)
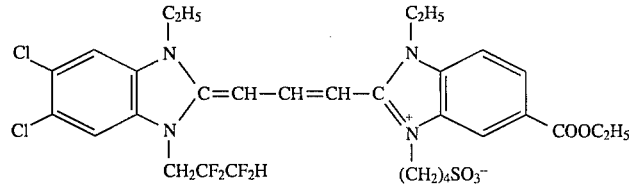

-continued

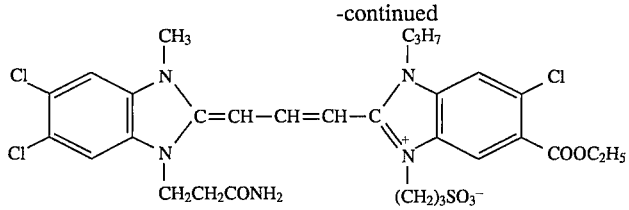

(6-T)

The amounts of the spectrally sensitizing dyes represented by general formula (4), (5) and (6) which are used in the invention differ according to the form and size of the silver halide grains, and they can be used in amounts of $4\times10^{-6}$ to $8\times10^{-3}$ mol per mol of silver halide. For example, when the silver halide grain size is 0.2 to 1.3 μm, the addition of $2\times10^{-7}$ to $3.5\times10^{-6}$ mol, and preferably of $6.5\times10^{-7}$ to $2.0\times10^{-6}$ mol, per square meter of the surface area of the silver halide grains is desirable.

The quaternary onium salt compounds and amines which can be used in the photosensitive materials of this invention are preferably the compounds of general formula (I), (II), (III) and (IV) disclosed in JP-A-62-250439, the amine compounds which have ballast groups disclosed in JP-A-62-222241, the compounds of general formulae (II-m) to (II-p) and the illustrative compounds II-1 to II-22 from line 13 of the upper right column on page 9 to line 10 of the upper left column on page 16 of JP-A-2-103536, the compounds disclosed in JP-A-1-179939 and the compounds of general formulae (I) and (II) disclosed in JP-A-4-212144.

Gelatin is useful as the binding agent or protective colloid for a photographic emulsion, but other hydrophilic colloid can also be used. For example, use can be made of gelatin derivatives, graft copolymers of gelatin and other polymers, proteins such as albumin and casein, cellulose derivatives such as hydroxyethylcellulose, carboxymethylcellulose and cellulose sulfate esters, sodium alginate, sugar derivatives such as starch derivatives, and various synthetic hydrophilic polymeric materials such as homopolymers or copolymers such as poly(vinyl alcohol), poly(acrylic acid), poly(methacrylic acid), polyacrylamide, polyvinylimidazole and poly(vinyl butyrate).

There is no need for the use of conventional infectious developers or highly alkaline developers of pH close to 13 disclosed in U.S. Pat. No. 2,419,975, and stable developers can be used to obtain photographic characteristics of high photographic speed with ultra-high contrast using silver halide photosensitive materials of this invention.

That is to say, the silver halide photosensitive materials of this invention can provide negative images of satisfactorily ultra-high contrast using developers which contain at least 0.15 mol/liter of sulfite as preservative and which are of pH from 9.6 to 11.0.

No particular limitation is imposed on the developing agent used in the developer which is used in this invention, but the inclusion of dihydroxybenzenes is desirable from the viewpoint of readily obtaining good screen dot quality. There are also cases in which combinations of dihydroxybenzenes and 1-phenyl-3-pyrazolidones and combinations of dihydroxybenzenes and p-aminophenols are used.

Hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, for example, are especially desirable as the dihydroxybenzene developing agents which are used in this invention.

The 1-phenyl-3-pyrazolidone and developing agents derived therefrom which are used in this invention include 1-phenyl-3-pyrazolidone and 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

N-Methyl-p-aminophenol, p-aminophenol, N-(β-hydroxyethyl)-p-aminophenol, N-(4-hydroxyphenyl)glycine, 2-methyl-p-aminophenol and p-benzylaminophenol, for example, can be cited as the p-aminophenol based developing agents are used in this invention. The use from among these of N-methyl-p-aminophenol is preferred.

Use of the developing agent in an amount of from 0.05 mol/liter to 0.8 mol/liter is generally desirable. Furthermore, in those cases were combinations of dihydroxybenzenes and 1-phenyl-3-pyrazolidones or p-aminophenols are used, the dihydroxybenzenes are preferably used in amounts of from 0.05 mol/liter to 0.5 mol/liter, and the 1-phenyl-3-pyrazolidones or p-aminophenols are preferably used in amounts of not more than 0.06 mol/liter.

Sodium sulfite, potassium sulfite, lithium sulfite, ammonium sulfite, sodium bisulfite, potassium metabisulfite and formaldehyde/sodium bisulfite, for example, can be used as the sulfite preservative which is used in this invention. The sulfite is preferably included in an amount of at least 0.15 mol/liter, and most desirably in an amount of at least 0.3 mol/liter. Furthermore, an upper limit of up to 2.5 mol/liter is desirable.

Moreover, pH controlling agents and buffering agents, such as sodium hydroxide, potassium hydroxide, sodium carbonate, potassium carbonate, sodium triphosphate and potassium triphosphate, are included among the alkalis which can be used to set the pH value. The pH of the developer is set between 9.6 and 11.0.

Compounds such as boric acid and borax, development inhibitors such as sodium bromide, potassium bromide and potassium iodide; organic solvents such as ethylene glycol, diethylene glycol, triethylene glycol, dimethylformamide, methylcellosolve, hexylene glycol, ethanol and methanol; and anti-foggants and agents for preventing the occurrence of black spotting (black pepper) such as 1-phenyl-5-mercaptotetrazole, indazole based compounds such as 5-nitroindazole and benzotriazole based compounds such as 5-methylbenzotriazole, may be included as additives which can be used in addition to the components mentioned above, and toners, surfactants, anti-foaming agents, hard water softening agents, film hardening agents and the amino compounds disclosed in JP-A-56-106244, for example, can be included, as required.

The compounds disclosed in JP-A-56-24347 can be used in the developer in this invention as agents for preventing silver contamination. The compounds disclosed in Japanese Patent Application No. 60-109743 can be used as dissolution promotors which are added to the developer. Moreover, the compounds disclosed in JP-A-60-93433 or the compounds disclosed in Japanese Patent Application No. 61-28708 can be used as the pH buffers which are used in the developer.

The generally used compositions can be used as fixers. As well as thiosulfates and thiocyanates, the organic sulfur compounds which are known to be effective as fixing agents can be used as fixing agents. Water soluble aluminum compounds (for example, aluminum sulfate and alum) may be included in the fixer as film hardening agents. The amount of water soluble aluminum salt used is generally 0.4 to 2.0 grams of Al/liter. Moreover, trivalent iron compounds can be used in the form of complexes with ethylenediamine tetraacetic acid as oxidizing agents.

The development processing temperature is generally selected in the region between 18° C. and 50° C., and preferably in the region between 25° C. and 43° C.

No particular limitation is imposed upon the various additives which can be used in the photosensitive materials of this invention, and those disclosed in the locations indicated below can be used for example.

| Item | Location |
|---|---|
| 1) Nucleation Promotors | The compounds of general formulae (II), (III), (IV), (V) and (VI) disclosed in Japanese Patent Application No. 4-237366, the general formulae (II-m) to (II-p) and illustrative compounds II-1 to II-22 from line 13 of the upper right column on page 9 to line 10 of the upper left column on page 16 of JP-A-2-103536, and the compounds disclosed in JP-A-1-179939 |
| 2) Surfactants | From line 7 of the upper right column to line 7 of the lower right column on page 9 of JP-A-2-12236 and from line 13 of the lower left column on page 2 to line 18 of the lower right column on page 4 of JP-A-2-18542. |
| 3) Anti-foggants | From line 19 of the lower right column on page 17 to line 4 of the upper right column and lines 1 to 5 of lower right column on page 18 of JP-A-2-103536, and the thiosulfinic acid compounds disclosed in JP-A-1-237538. |
| 4) Polymer Latexes | From line 12 to line 20 of the lower left column on page 18 of JP-A-2-103536. |
| 5) Compounds which have Acid Groups | From line 6 of the lower right column on page 18 to line 1 of the upper left column on page 19 of JP-A-2-103536. |
| 6) Matting Agents, Lubricants, Plasticizers | From line 15 of the upper left column on page 19 to line 15 of the upper right column on page 19 of JP-A-2-103536. |
| 7) Film Hardening Agents | From line 5 to line 17 of the upper right column on page 18 of JP-A-2-103536. |
| 8) Dyes | The dyes from line 1 to line 18 of the lower right column on page 17 of JP-A-2-103536 and the solid dyes disclosed in JP-A-2-294638 and Japanese Patent Application No. 3-185773. |
| 9) Binders | From line 1 to line 20 of the lower right column on page 3 of JP-A-2-18542. |
| 10) Anti-black Spotting Agents | The compounds disclosed in U.S. Pat. No. 4,956,257 and JP-A-1-118832. |
| 11) Redox Compounds | The compounds represented by general formula (I) (and especially illustrative compounds 1 to 50) of JP-A-2-301743, the general formula (R-1), (R-2) and (R-3) and illustrative compounds 1 to 75 disclosed on pages 3 to 20 of JP-A-3-174143, and the compounds disclosed in Japanese Patent Application Nos. 3-69466 and 3-15648. |
| 12) Monomethine Compounds | The compounds of general formula (II) and especially illustrative compounds (II-1) to (II-26) of JP-A-2-287532. |
| 13) Dihydroxybenzenes | The compounds disclosed from the upper left column on page 11 to the lower left column on page 12 of JP-A-3-39948 and in EP 452772A. |

The invention is described in practical terms below by means of illustrative examples, but the invention is not limited by these examples.

ILLUSTRATIVE EXAMPLES

EXAMPLE 1

Emulsions were prepared using the methods indicated below.

Emulsion A

A 0.13M aqueous silver nitrate solution and an aqueous halogen salt solution which contained 0.04M potassium bromide and 0.09M sodium chloride and which also contained $1.5\times10^{-7}$ mol per mol of silver of $K_2Rh(H_2O)Cl_5$ and $2\times10^{-7}$ mol per mol of silver of $K_3IrCl_6$ were added using the double jet method over a period of 12 minutes at 38° C. with stirring to an aqueous gelatin solution which contained sodium chloride and 1,3-dimethyl-2-imidazolidinethione. Silver chlorobromide grains of an average grain size 0.14 μm with a silver chloride content of 70 mol % were obtained when nuclei formation was carried out in this way. Next, a 0.87M aqueous silver nitrate solution and an aqueous halogen salt solution which contained 0.26M potassium bromide and 0.65M sodium chloride were added in the same way with the double jet method over a period of 20 minutes.

Emulsions A to D shown in Table 1 were prepared using the same procedure.

Subsequently, conversion was carried out with the addition of a $1\times10^{-3}$ mol KI solution to each emulsion, water washing was carried out using the flocculation method in the usual way, 40 grams of gelatin were added per mol of silver, the pH was adjusted to 6.5 and the pAg value was adjusted to 7.5. Then the sensitizing dyes of this invention and the comparative compounds indicated below were added, as indicated in Table 2, at a temperature of 60° C. Moreover, 7 mg of sodium benzenethiosulfonate, 2 mg of benzenesulfinic acid, 8 mg of chloroauric acid, 200 mg of potassium thiocyanate and 5 mg of sodium thiosulfate were added, per mol of silver. Chemical sensitization was carried out by heating to 60° C. for 45 minutes, after which 150 mg of 4-hydroxy-6-methyl-1,3,3a,7-tetraazaindene were added as a stabilizer and 100 mg of proxel were added as a fungicide. The grains obtained were all cubic silver iodochlorobromide grains of an average grain size 0.25 μm with a silver chloride content of 69.9 mol %. (Variation coefficient 10%).

Emulsion E

A 0.13M aqueous silver nitrate solution and an aqueous halogen salt solution which contained 0.09M potassium bromide and 0.04M sodium chloride and which also contained $1.5\times10^{-7}$ mol per mol of silver of $K_2Rh(H_2O)Cl_5$ and $2\times10^{-7}$ mol per mol of silver of $K_3IrCl_6$ were added using the double jet method over a period of 12 minutes at 38° C. with stirring to an aqueous gelatin solution which contained sodium chloride and 1,3-dimethyl-2-imidazolidinethione. Silver chlorobromide grains of an average grain size 0.14 μm with a silver chloride content of 30 mol % were obtained when nuclei formation was carried out in this way. Next, a 0.87M aqueous silver nitrate solution and an aqueous halogen salt solution which contained 0.61M potassium bromide and 0.30M sodium chloride were added in the same way with the double jet method over a period of 20 minutes.

Subsequently, conversion was carried out with the addition of $1\times10^{-3}$ mol KI solution, water washing was carried out using the flocculation method in the usual way, 40 grams of gelatin were added per mol of silver, the pH was adjusted to 6.5 and the pAg value was adjusted to 7.5. Then Sensitizing Dye (5-G) of this invention was added at a temperature of 60° C. as indicated in Table 2. Moreover, 7 mg of sodium benzenethiosulfonate, 2 mg of benzenesulfinic acid, 8 mg of chloroauric acid, 200 mg of potassium thiocyanate and 5 mg of sodium thiosulfate were added, per mol of silver. Chemical sensitization was carried out by heating to 60° C. for 45 minutes, after which 150 mg of 4-hydroxy-6-methyl-1,3,3a,7-tetra-azaindene were added as a stabilizer and 100 mg of proxel were added as a fungicide. The grains obtained were all cubic silver iodochlorobromide grains of an average grain size 0.25 μm with a silver chloride content of 29.9 mol %. (Variation coefficient 10%).

Preparation of Coated Samples

The mercapto compound indicated by formula (a) below ($3\times10^{-4}$ mol per mol of silver), $4\times10^{-4}$ mol per mol of silver of the mercapto compound indicated by formula (b) below, $4\times10^{-4}$ mol per mol of silver of the triazine compound indicated by formula (c) below, $2\times10^{-3}$ mol per mol of silver of 5-chloro-8-hydroxyquinone, $3\times10^{-4}$ mol per mol of silver of the compound of formula (d) indicated below and $5\times10^{-3}$ mol per mol of silver of the hydrazine derivatives of this invention and comparative hydrazine derivatives shown in Table 2 were added to the above-mentioned emulsions. Moreover, N-oleyl-N-methyltaurine sodium salt, was added so as to provide a coated weight of 30 mg/m$^2$, and 200 mg/m$^2$ of the water soluble latex indicated by formula (e), 200 mg/m$^2$ of a dispersion of poly(ethyl acrylate) and the nucleation promoters indicated by the structural formulae below, 200 mg/m$^2$ of a methyl acrylate/2-acrylamido-2-methylpropanesulfonic acid sodium salt/2-acetoacetoxyethyl methacrylate latex copolymer (ratio by weight 88:5:7), and 200 mg/m$^2$ of 1,3-divinylsulfonyl-2-propanol as a film hardening agent were added. The pH of the resulting solution was adjusted to 6.0. Moreover, the coating liquids were coated in such a way as to provide coated silver weights of 3.0 g/m$^2$ on poly(ethylene terephthalate) films on which an under-layer had been established.

(a)

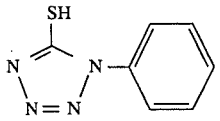

(b)

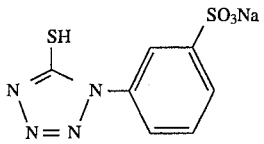

(c)

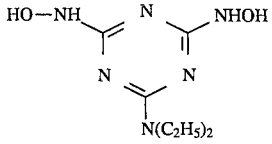

(d)

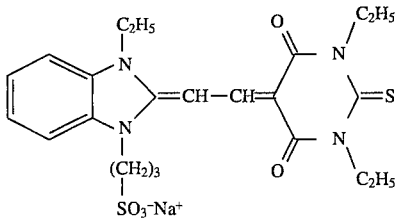

(e)

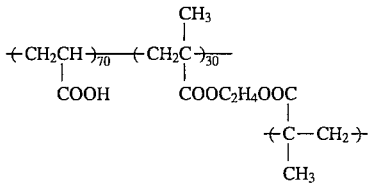

Comparative Compound A

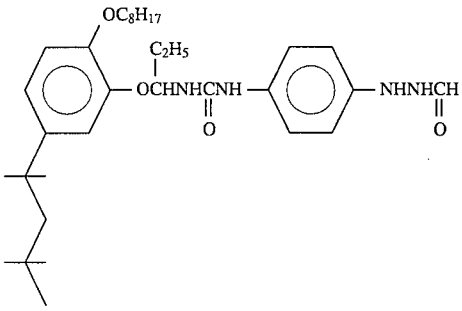

-continued

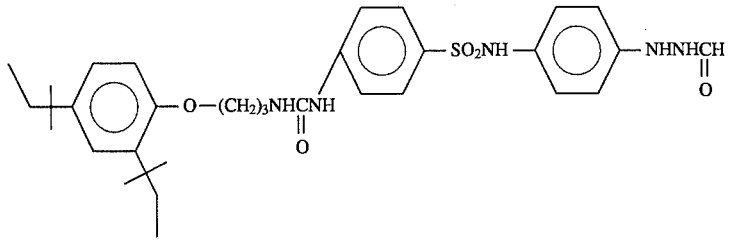

Comparative Compound B

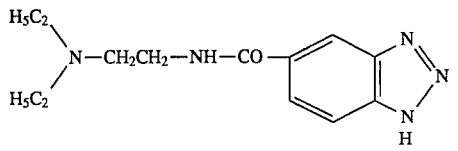

10 mg/m²

Nucleation Promoter 1

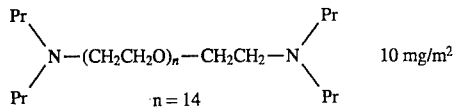

10 mg/m²

Nucleation Promotor 2

A layer containing 1.0 g/m² of gelatin, 40 mg/m² of amorphous $SiO_2$ matting agent of an average particle size about 3.5μ, 200 mg/m² of hydroquinone, 5 mg/m² of the fluorine based surfactant indicated by the structural formula (f) below and 100 mg/m² of sodium dodecylbenzenesulfonate as coating promoters were coated as a protective layer over these emulsion layers and samples were obtained as shown in Table 2. Moreover, colloidal silica of this invention and polyacrylamide derivatives were added as indicated in Table 2, and the dynamic friction coefficients of the protective layers were adjusted by means of the amount of silicone oil which was added.

Furthermore, a backing layer and a backing layer protective layer, the formulations of which are indicated below were also coated.

(f)

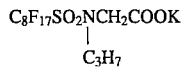

Backing Layer Formulation

| | |
|---|---|
| Gelatin | 3 g/m² |
| Latex: Poly(ethyl acrylate) | 2 g/m² |
| Surfactant: Sodium p-dodecylbenzenesulfonate | 40 mg/m² |
| 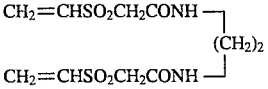 | 110 mg/m² |
| $SnO_2$/Sb (90/10 by weight, average particle size 0.20 μm) | 200 mg/m² |
| Dye: A mixture of Dyes (a), (b) and (c) | |
| Dye (a) 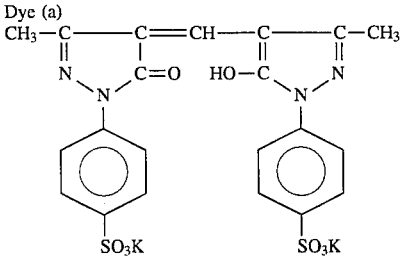 | 50 mg/m² |

-continued

Dye (b) 100 mg/m²

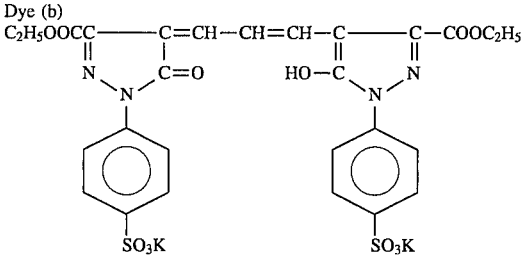

Dye (c) 50 mg/m²

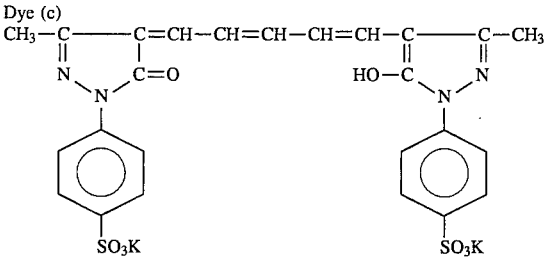

Backing Layer Protective Layer

| | |
|---|---|
| Gelatin | 0.8 g/m² |
| Fine poly(methyl methacrylate) particles (average particle size 4.5μ) | 30 mg/m² |
| Dihexyl-α-sulfosuccinate, sodium salt | 15 mg/m² |
| p-Dodecylbenzenesulfonic acid, sodium salt | 15 mg/m² |
| Sodium acetate | 40 mg/m² |

TABLE 1

| | | $K_2Rh(H_2O)Cl_5$ | | $K_3IrCl_6$ | |
|---|---|---|---|---|---|
| | | Location of | Amount Added | Location of | Amount Added |
| Emulsion | Halogen Composition | Addition | mol/mol · Ag | Addition | mol/mol · Ag |
| A | $AgBr_{30}Cl_{69.9}I_{0.1}$ | core | $1.5 \times 10^{-7}$ | core | $2 \times 10^{-7}$ |
| B | $AgBr_{30}Cl_{69.9}I_{0.1}$ | core | " | shell | " |
| C | $AgBr_{30}Cl_{69.9}I_{0.1}$ | c/s | " | c/s | " |
| D | $AgBr_{30}Cl_{69.9}I_{0.1}$ | — | — | core | " |
| E | $AgBr_{70}Cl_{29.9}I_{0.1}$ | core | $1.5 \times 10^{-7}$ | core | $2 \times 10^{-7}$ |

The samples obtained were exposed with tungsten light through a step-wedge and processed for 30 seconds at 38° C. in an FG-680A model automatic processor (made by the Fuji Photo Film Co., Ltd.) using the developer, the formulation of which is indicated below for the developer and GR-F1 (made by the Fuji Photo Film Co., Ltd.) for the fixer. The results obtained upon evaluation are shown in Table 2.

Here, the photographic speed indicates the relative value of the reciprocal of the exposure which gave a density of 1.5 on development for 30 seconds at 38° C. The value of gamma was obtained using the following equation by which it is defined.

$$\text{Gamma} = \frac{3.0 - 0.3}{\log(\text{Exposure which gave density } 3.0) - \log(\text{Exposure which gave density } 0.3)}$$

Black spotting was evaluated by observing the developed parts on development for 30 seconds at 38° C. using a microscope and the quality was assessed with a score of 5 for the best and a score of 1 for the worst. Scores of 5 or 4 indicate a material which could be used in practice, a score of 3 indicates a material which is poor but which could be used, and a score-of 2 or 1 indicates a material which is of no practical use.

Developer 1

| Concentrate | |
|---|---|
| Sodium metabisulfite | 145 grams |
| Potassium hydroxide (45%) | 178 grams |
| Diethylenetriamine pentaacetic acid, sodium salt | 15 grams |
| Sodium bromide | 12 grams |
| Hydroquinone | 65 grams |
| 1-Phenyl-4-hydroxymethyl-4-methyl-3-pyrazolidone | 2.9 grams |
| Benzotriazole | 0.4 grams |
| 1-Phenyl-5-mercaptotetrazole | 0.05 grams |
| Sodium hydroxide (50%) | 46 grams |
| Boric acid | 6.9 grams |
| Diethylene glycol | 120 grams |
| Potassium carbonate (47%) | 120 grams |
| Water to make | 1 liter |

The above-mentioned concentrate was diluted in the proportions of 1 part concentrate to 2 parts water to prepare Developer 1 of pH 10.5

Developer 2

Each sample (100% blackening) after exposure was processed without replenishment in an amount corresponding to 30 sheets calculated overall using Developer 1 to prepare Developer 2.

Developer 3

Developer 1 was left to stand for 1 month at 38° C. without replenishment and without processing samples to prepare Developer 3.

TABLE 2

| | | Hydrazine Derivative | | Colloidal Silica/Acrylamide | | | Dynamic Friction Coefficient | Developer 1 | | Developer 2 | | Pressure | Developer 3 |
|---|---|---|---|---|---|---|---|---|---|---|---|---|---|
| Sample Number | Emulsion | Compound | Amount Added (mol/mol · Ag) | Layer to which it is Added | Type | Amount Added (mg/m²) | Coefficient ($\mu_k$) | Photographic Speed | γ | Photographic Speed | γ | Fogging (g) | Black Spotting |
| 1 | A | (1-1) | $5 \times 10^{-3}$ | — | — | — | 0.45 | 100 | 19 | 96 | 18 | 20 | 4 |
| 2 | " | " | " | Upper Protective Layer | Colloidal Silica | 200 | 0.38 | 100 | 19 | 95 | 18 | 40 | 4 |
| 3 This Invention | " | " | " | " | " | " | 0.30 | 100 | 19 | 96 | 18 | 80 | 4 |
| 4 | " | " | " | " | III-1 | " | 0.37 | 100 | 19 | 96 | 18 | 40 | 4 |
| 5 This Invention | " | " | " | " | " | " | 0.30 | 100 | 19 | 96 | 18 | 70 | 4 |
| 6 | " | " | " | Emulsion Layer | Colloidal Silica | " | 0.45 | 98 | 18 | 95 | 18 | 30 | 5 |
| 7 This Invention | " | " | " | " | " | " | 0.30 | 98 | 18 | 93 | 17 | 120 | 5 |
| 8 This Invention | " | " | " | " | " | " | 0.25 | 98 | 18 | 93 | 17 | 150 | 5 |
| 9 | " | " | " | " | III-1 | " | 0.3 | 102 | 18 | 97 | 17 | 30 | 5 |
| 10 This Invention | " | " | " | " | " | " | 0.25 | 102 | 18 | 97 | 17 | 120 | 5 |
| 11 | " | " | " | " | III-4 | " | 0.39 | 100 | 18 | 95 | 17 | 35 | 5 |
| 12 This Invention | " | " | " | " | " | " | 0.3 | 100 | 18 | 95 | 17 | 110 | 5 |
| 13 This Invention | " | (1-3) | " | " | Colloidal Silica | " | " | 105 | 19 | 98 | 17 | 115 | 4 |
| 14 This Invention | " | (1-9) | " | " | " | " | " | 103 | 19 | 95 | 18 | 120 | 4 |
| 15 This Invention | " | (2-16) | " | " | " | " | " | 98 | 20 | 93 | 18 | 115 | 5 |
| 16 This Invention | " | (3-1) | " | " | " | " | " | 95 | 20 | 91 | 19 | 118 | 4 |
| 17 This Invention | B | (1-1) | " | " | " | " | " | 98 | 20 | 93 | 18 | 112 | 4 |
| 18 This Invention | C | " | " | " | " | " | " | 96 | 21 | 91 | 19 | 110 | 4 |
| 19 | D | " | " | " | " | " | 0.40 | 140 | 17 | 105 | 12 | 30 | 2 |
| 20 | " | " | " | " | " | " | 0.30 | 140 | 17 | 105 | 12 | 50 | 2 |
| 21 | E | " | " | " | " | " | 0.45 | 120 | 18 | 90 | 11 | 60 | 2 |
| 22 | " | " | " | " | " | " | 0.30 | 120 | 18 | 90 | 11 | 100 | 2 |
| 23 | A | Comparative A | " | " | " | " | " | 80 | 13 | 71 | 8 | 120 | 5 |
| 24 | " | Comparative B | " | " | " | " | " | 87 | 13 | 73 | 9 | 120 | 5 |

As is apparent from the results of Table 2, Samples of this invention can maintain good photographic performances against the fluctuation of developer composition.

EXAMPLE 2

The sensitizing dyes used in this invention and Comparative Dyes S-1 and S-2, and hydrazine derivatives, wee added n the way indicated in Table 3 using Emulsion A of Example 1. Samples 25 to 31 of which the structure was just the same as in Example 1 were prepared. Moreover, colloidal silica was added to the emulsion layer in an amount of 150 mg/m$^2$. The samples were evaluated using the same methods as in Example 1.

The results obtained are shown in Table 3. It is clear from Table 3, that the sensitizing dyes used in this invention show good performance.

TABLE 3

| Sample Number | Dye | Hydrazine Derivative: Compound | Hydrazine Derivative: Amount Added (mol/mol · Ag) | Dynamic Friction Coefficient ($\mu_k$) | Developer 1: Photographic Speed | Developer 1: γ | Developer 3: Black Spotting | Pressure Fogging (g) |
|---|---|---|---|---|---|---|---|---|
| 25 | 4-Q | (3-1) | $5 \times 10^{-3}$ | 0.45 | 100 | 19 | 5 | 20 |
| 26 | " | " | " | 0.30 | 100 | 19 | 4 | 120 |
| 27 | " | " | " | 0.25 | 100 | 19 | 4 | 150 |
| 28 | 4-S | " | " | " | 102 | 19 | 5 | 150 |
| 29 | 5-B | " | " | " | 98 | 19 | 4 | 135 |
| 30 | 6-C | " | " | " | 105 | 21 | 5 | 150 |
| 31 | 6-C | " | " | " | 107 | 22 | 5 | 150 |
| 32 | Comparative S-1 | " | " | " | 105 | 18 | 3 | 80 |
| 33 | Comparative S-2 | " | " | " | 102 | 18 | 3 | 90 |

Comparative Dye S-1

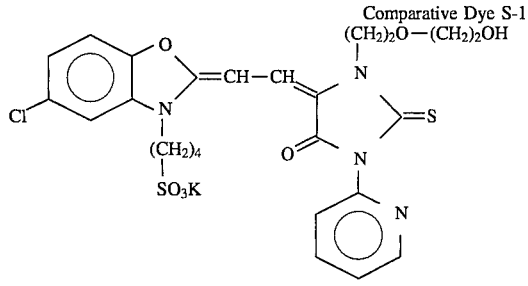

Comparative Dye S-2

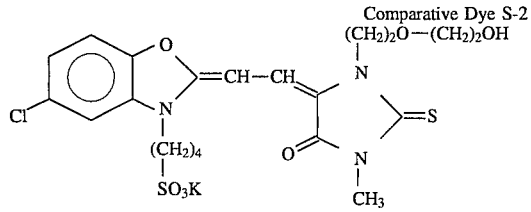

While the invention has been described in detail and with reference to specific embodiments thereof, it will be apparent to one skilled in the art that various changes and modifications can be made therein without departing from the spirit and scope thereof.

What is claimed is:

1. A method for forming an image comprising, the step of processing a photographic photosensitive material with a developer having a pH of 9.6 to 11.0, wherein the photographic photosensitive material comprises a support, having thereon at least one silver halide emulsion layer and at least one protective layer over said emulsion layer, wherein said silver halide emulsion layer is comprised of silver halide grains having a silver chloride content of at least 50 mol % which contain from $1\times10^{-8}$ to $5\times10^{-6}$ mol of a rhodium compound per mol of silver, at least one hydrazine derivative selected from among those of general formula (1) or (2) indicated below is included in at least one of said emulsion layer or another hydrophilic colloid layer, at least one compound selected from among colloidal silica and polyacrylamide derivatives is included in at least one of said silver halide layer and another hydrophilic colloid layer, and the dynamic friction coefficient of the outermost layer of said protective layer is not more than 0.35:

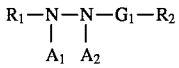

General Formula (1)

wherein $R_1$ represents an aliphatic group or an aromatic group which includes either a partial structure of —O—$(CH_2CH_2O)_n$—, —O—$(CH_2CH(CH_3)O)_n$— or —O—$(CH_2CH(OH)CH_2O)_n$— (where n is an integer of 3 or more), or which contains a quaternary ammonium cation; $G_1$ represents —CO—, —COCO—, —CS—, —C(=$NG_2R_2$)—, —SO—, —$SO_2$— or —P(O)($G_2R_2$)—; $G_2$ represents a single bond, —O—, —S— or —N($R_2$)—, $R_2$ represents an aliphatic group, an aromatic group or a hydrogen atom, and in those cases where a plurality of $R_2$ groups is present within the hydrazine derivative of formula (1), these groups may be the same or different;

one of $A_1$ and $A_2$ is a hydrogen atom, and the other represents a hydrogen atom or an acyl group, or an alkyl or aryl sulfonyl group;

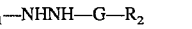

General Formula (2)

wherein $R_1$ represents an aliphatic group, an aromatic group or a heterocyclic group; G represents —CO—, —$SO_2$—, —SO—, —COCO—, a thiocarbonyl group, an iminomethylene group or —P(O)($R_3$)—, and $R_2$ represents an alkyl group in which the carbon atom of the alkyl group bonded to G is also bonded to at least one electron attractive group; $R_3$ represents a hydrogen atom, an aliphatic group, an aromatic group, an alkoxy group, an aryloxy group or an amino group; $R_1$ and $R_2$ of formula (2) do not contain a silver halide adsorptive group;

wherein said silver halide emulsion has been spectrally sensitized by means of at least one dye selected from among those of general formula (4), (5) or (6):

General Formula (4)

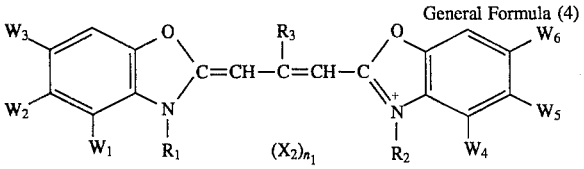

wherein $W_1$ and $W_4$ represent hydrogen atoms; $W_3$ and $W_6$ represent hydrogen atoms, methyl groups or methoxy groups; $W_2$ is an alkyl group which may be branched of a total carbon number not more than 6, an alkoxy group which has a total carbon number of not more than 5, a bromine atom, an iodine atom, an aryl group of a total carbon number not more than 9 or a chlorine atom when $W_3$ represents a methyl group or a methoxy group, or it may be joined with $W_1$ or $W_3$ to form a benzene ring; $W_5$ represents an alkyl group which may be branched of a total carbon number not more than 6, an alkoxy group of a total carbon number not more than 5, a halogen atom, a hydroxy group, an aryl group of a total carbon number not more than 9, an aryloxy group of a total carbon number not more than 9, an arylthio group of a total carbon number not more than 8, an alkylthio group of a total carbon number not more than 4 or an acylamino group of a total carbon number not more than 4, or $W_5$ may be joined with $W_4$ or $W_6$ to form a benzene ring;

$R_1$ and $R_2$ may be the same or different, representing alkenyl groups or alkyl groups having a total carbon number not more than 10, and at least one of $R_1$ and $R_2$ is a group which contains a sulfo group or a carboxyl group;

$R_3$ represents a lower alkyl group; $X_1$ represents a counter ion which is required to neutralize the charge; $n_1$ represents 0 or 1, and is 0 when an intramolecular salt is formed;

General Formula (5)

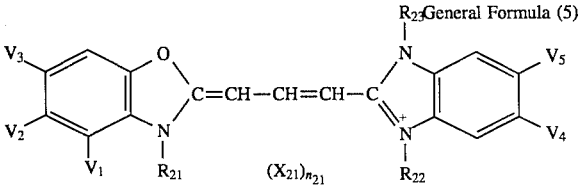

wherein $V_1$ represents a hydrogen atom; $V_2$ represents a hydrogen atom, a halogen atom, a hydroxy group, a lower alkyl group which may be branched, a lower alkoxy group, an aryl group of a total carbon number not more than 9, an aryloxy group of a total carbon number not more than 9, an arylthio group of a total carbon number not more than 8, a lower alkylthio group or an acylamino group of total carbon number not more than 4, or it may be joined with $V_1$ or $V_3$ to form a benzene ring; $V_3$ represents a hydrogen atom, a methyl group or a methoxy group; $V_4$ represents an electron attractive group; $V_5$ represents a hydrogen atom, a fluorine atom, a chlorine atom or a bromine atom; $R_{21}$, $R_{22}$ and $R_{23}$ may be the same or different, representing alkenyl groups or alkyl groups having a total carbon number not more than 10, and at least one of $R_{21}$, $R_{22}$ and $R_{23}$ is a group which has a sulfo group or a carboxyl group; $X_{21}$ represents a counter ion which is required to neutralize the charge; and $n_{21}$ represents 0 or 1, and $n_{21}$ is 0 when an intramolecular salt is formed;

General Formula (6)

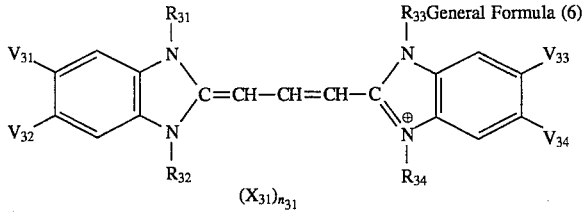

wherein $V_{31}$ and $V_{33}$ represent a hydrogen atom or an electron attractive group and $V_{32}$ and $V_{34}$ represent an electron attractive group; $R_{31}$, $R_{32}$, $R_{33}$ and $R_{34}$ may be the same or different, represent an alkyl group having a total carbon number of 10 or less or an alkenyl group having a total carbon number of 10 or less, and at least one of $R_{31}$, $R_{32}$, $R_{33}$ and $R_{34}$ have a sulfo group or carboxyl group; $X_{31}$ represents a counter ion which is required to neutralize the charge; $n_{31}$ represents 0 or 1, and it is 0 when an intramolecular salt is formed.

2. The method for forming an image as in claim 1, wherein amine compounds or quaternary onium compounds are included in at least one silver halide emulsion layer or another hydrophilic colloid layer.

3. The method for forming an image as in claim 1, wherein the hydrazine derivative is according to formula (1).

4. The method for forming an image as in claim 1, wherein the hydrazine derivative is according to formula (2).

5. The method for forming an image as in claim 1, wherein the dye is according to formula (4).

6. The method for forming an image as in claim 1, wherein the dye is according to formula (5).

7. The method for forming an image as in claim 1, wherein the dye is according to formula (6).

8. The method for forming an image as in claim 3, wherein n is an integer of from 3 to 15.

9. The method for forming an image as in claim 1, wherein said aliphatic group or aromatic group representing $R_1$ in General Formula (1) is unsubstituted.

10. The method for forming an image as in claim 1, wherein said aliphatic group or aromatic group representing $R_1$ in General Formula (1) is substituted by a member selected from the group consisting of an alkyl group, an aralkyl group, an alkenyl group, an alkynyl group, an alkoxy group, an aryl group, an amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carboxamido group, a sulfonamido group, a carboxyl group, and a phosphoric acid amido group.

11. The method for forming an image as in claim 1, wherein said aliphatic group, aromatic group or heterocyclic group representing $R_1$ in General Formula (2) is substituted by a member selected from the group consisting of an alkyl group, an aralkyl group, an alkenyl group, an alkynyl group, an alkoxy group, an aryl group, an amino group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, n-carboxyl group, alkyl and aryloxycarbonyl group, an acyl group, an alkoxycarbonyl group, an acyloxy group, a carboxamido group, a sulfonamido group, a nitro group, and an alkylthio group.

12. The method for forming an image as in claim 1, wherein said aliphatic group, aromatic group or heterocyclic group representing $R_1$ in General Formula (2) is unsubstituted.

13. The method for forming an image as in claim 1, wherein at least one of said alkenyl group or alkyl group representing $R_1$ and $R_2$ in General Formula (4) is unsubstituted.

14. The method for forming an image as in claim 1, wherein at least one of said alkenyl group or alkyl group representing $R_1$ and $R_2$ in General Formula (4) is substituted by at least one member selected from the group consisting of a sulfo group, a carboxyl group, a halogen atom, a hydroxyl group, an alkoxy group having a carbon number not more than 6, an aryl group having a carbon number not more than 8, a heterocyclic group, an aryloxy group having a carbon number not more than 8, an acyl group having a carbon number not more than 8, an alkoxycarbonyl group having a carbon number not more than 6, a cyano group, an alkylthio group having a carbon number not more than 6, an arylthio group having a carbon number not more than 8, a carbamoyl group having a carbon number not more than 8, and an acylamino group having a carbon number not more than 8.

15. The method for forming an image as in claim 1, wherein said lower alkyl group representing $R_3$ in General Formula (4) is unsubstituted.

16. The method for forming an image as in claim 1, wherein said alkyl group representing $R_3$ in General Formula (4) is substituted by a member selected from the group consisting of a methyl group, an ethyl group, a propyl group, a methoxyethyl group, a benzyl group, and a phenethyl group.

17. The method for forming an image as in claim 1, wherein at least one of said alkenyl groups or alkyl groups representing $R_{21}$, $R_{22}$, and $R_{23}$ in General Formula (5) is unsubstituted.

18. The method for forming an image as in claim 1, wherein at least one of said alkyl group or alkenyl groups representing $R_{31}$, $R_{32}$, $R_{33}$, and $R_{34}$ in General Formula (6) is unsubstituted.

* * * * *